US008315545B2

(12) United States Patent
Sudo et al.

(10) Patent No.: US 8,315,545 B2
(45) Date of Patent: Nov. 20, 2012

(54) IMAGE FORMING APPARATUS UTILIZING BOTH A TRANSFER BELT AND A DIRECT TRANSFER MEMBER

(75) Inventors: Kazuhisa Sudo, Kawasaki (JP); Mitsuru Takahashi, Kawasaki (JP); Kazuosa Kuma, Yokohama (JP); Tsutomu Katoh, Kawasaki (JP); Takeshi Fukao, Yokohama (JP); Shinichi Kawahara, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 554 days.

(21) Appl. No.: 12/557,997

(22) Filed: Sep. 11, 2009

(65) Prior Publication Data

US 2010/0061752 A1 Mar. 11, 2010

(30) Foreign Application Priority Data

Sep. 11, 2008 (JP) ..... 2008-233072
Jun. 16, 2009 (JP) ..... 2009-142938

(51) Int. Cl.
*G03G 15/01* (2006.01)

(52) U.S. Cl. ..... 399/301

(58) Field of Classification Search ..... 399/301, 399/49, 300, 66, 297, 299, 302, 303, 308
See application file for complete search history.

(56) References Cited

U.S. PATENT DOCUMENTS 5,870,650 A 2/1999 Takahashi et al.
5,983,060 A 11/1999 Namekata et al.
6,006,062 A 12/1999 Takahashi et al.
6,035,157 A 3/2000 Takahashi et al.
6,223,008 B1 4/2001 Takahashi et al.
6,269,228 B1 7/2001 Kayahara et al.
6,505,024 B2 1/2003 Kayahara et al.
RE38,206 E 7/2003 Bisaiji et al.
6,611,672 B2 8/2003 Aoki et al.
6,654,574 B2 11/2003 Kayahara et al.
6,701,118 B2 3/2004 Kayahara et al.
6,990,309 B2 1/2006 Kayahara et al.
(Continued)

FOREIGN PATENT DOCUMENTS

JP 2912238 4/1999
(Continued)

OTHER PUBLICATIONS

U.S. Appl. No. 12/828,612, filed Jul. 1, 2010, Furuya, et al.

*Primary Examiner* — Walter L Lindsay, Jr.
*Assistant Examiner* — Billy J Lactaoen
(74) *Attorney, Agent, or Firm* — Oblon, Spivak, McClelland, Maier & Neustadt, L.L.P.

(57) ABSTRACT

An image forming apparatus includes first and second belt members, at least one color image carrier, a separate image carrier, a primary transfer member, a secondary transfer mechanism, a direct transfer member, a first image detector to detect positional deviation of transferred images from reference pattern images, and a controller to transfer the reference pattern images formed on the at least one color image carrier and the separate image carrier onto the first belt member or onto the second belt member, convey the reference pattern images to the first image detector, cause the first image detector to detect the reference pattern images, and adjust one or more image forming conditions of the image forming apparatus to prevent positional deviation of the transferred images from the reference pattern images based on detection results obtained by the first image detector.

12 Claims, 9 Drawing Sheets

U.S. PATENT DOCUMENTS

| | | | | |
|---|---|---|---|---|
| 7,362,993 | B2 | 4/2008 | Takahashi | |
| 2007/0164505 | A1 | 7/2007 | Ishibashi et al. | |
| 2007/0223957 | A1* | 9/2007 | Shimmura | 399/101 |
| 2008/0175619 | A1 | 7/2008 | Katoh et al. | |
| 2009/0162110 | A1* | 6/2009 | Murayama | 399/301 |
| 2009/0196638 | A1 | 8/2009 | Sukesako et al. | |

FOREIGN PATENT DOCUMENTS

| | | |
|---|---|---|
| JP | 2000-35703 | 2/2000 |
| JP | 3366969 | 11/2002 |
| JP | 2002-357938 | 12/2002 |
| JP | 2002-365995 | 12/2002 |
| JP | 2006-30519 | 2/2006 |

* cited by examiner

IMAGE FORMING APPARATUS UTILIZING BOTH A TRANSFER BELT AND A DIRECT TRANSFER MEMBER

CROSS-REFERENCE TO RELATED APPLICATIONS

The present invention claims priority pursuant to 35 U.S.C. §119 from Japanese Patent Application No. 2008-233072, filed on Sep. 11, 2008 in the Japan Patent Office, and Japanese Patent Application No. 2009-142938, filed on Jun. 16, 2009 in the Japan Patent Office, which are hereby incorporated by reference herein in their entirety.

BACKGROUND OF THE INVENTION

1. Field of the Invention

Exemplary embodiments of the present invention generally relate to an image forming apparatus and a control method for same, and more particularly, to an image forming apparatus such as a laser beam printer, a LED printer, a facsimile machine, and the like, and a control method for the above-described image forming apparatus.

2. Discussion of the Related Art

Related-art image forming apparatuses include multiple image forming units to form different single color images that correspond to respective colors including black.

In particular, one related-art image forming apparatus includes a direct image transfer position and a secondary image transfer position.

A black image formed by a black image forming unit is transferred at the direct image transfer position directly onto a recording medium.

By contrast, single color images other than black, which are formed at the corresponding image forming units of different colors (typically yellow, cyan, and magenta) and transferred as a composite color image onto an intermediate transfer belt in a primary image transfer operation, are transferred again at the secondary image transfer position to transfer the composite color image onto a recording medium in a secondary image transfer operation.

The secondary image transfer position is located upstream from the direct image transfer position in a direction of conveyance of recording medium. The intermediate transfer belt is extended around multiple rotatable rollers and is rotated by a drive roller that is one of the multiple rollers.

Further, such related-art image forming apparatus includes a sheet conveyance belt. Similarly to the intermediate transfer belt, the sheet conveyance belt is extended around multiple rotatable rollers to carry and convey the recording medium to the direct image transfer position and then on to the secondary image transfer position.

In this related-art image forming apparatus, the sheet conveyance belt conveys the recording medium through the direct image transfer position and the secondary image transfer position to overlay first the color images transferred from the secondary image transfer position onto the recording medium and then the black image transferred from the direct image transfer position onto the recording medium to form a full-color image on the recording medium.

At present, image forming apparatuses currently on the market that are capable of producing color images are used at a rate of 70% to 80% to produce monochrome (black-and-white) images. Since black toner is consumed when producing full-color images as well as monochrome images, in the interest of saving resources and reducing costs it is desirable that an amount of black toner consumed when producing full-color images be reduced.

Similar to the above-described related-art image forming apparatus, toner image transfer efficiency increases more by transferring a black image formed on an image carrier of a black image forming unit onto the recording medium directly than by transferring the black image from the image carrier onto the recording medium indirectly, that is, via the intermediate transfer belt. Therefore, a smaller amount of black toner can be consumed in forming a black image on an image carrier incorporated in the black image forming unit when transferring the black image from the image carrier onto the recording medium directly than when transferring the black image from the image carrier onto the recording medium indirectly via the intermediate transfer belt.

The color images produced in the above-described related-art image forming apparatus are transferred onto the recording medium conveyed by the sheet conveyance belt at the direct image transfer position and the secondary image transfer position. The different transfer positions of the color images transferred onto the recording medium can easily cause positional deviation between the color images on the recording medium.

Moreover, the relative positions of the transfer positions in the direction of conveyance of the recording medium does not affect this susceptibility to positional deviation between the color images on the recording medium. Thus, in the above-described related-art image forming apparatus, the secondary image transfer position is located upstream from the direct image transfer position in the direction of conveyance of the recording medium. However, even when the secondary image transfer position is located downstream from the direct image transfer position in the direction of conveyance of the recording medium, a similar problem to the above-described problem of positional deviation between the color images on the recording medium may still occur.

SUMMARY OF THE INVENTION

Exemplary aspects of the present invention have been made in view of the above-described circumstances and provide an image forming apparatus that can effectively contribute to resource saving and cost saving and prevent positional deviation between images formed on a recording medium.

Other exemplary aspects of the present invention provide a control method for the above-described image forming apparatus.

In one exemplary embodiment, an image forming apparatus includes a first belt member rotatably extended around multiple roller members, a first image forming unit including at least one first color image carrier disposed facing an outer surface of the first belt member, the first image forming unit to form a first image on the at least one first color image carrier, a primary transfer member to transfer the first image formed on the at least one first color image carrier onto the first belt member, a secondary transfer mechanism to transfer the first image formed on the first belt member onto a recording medium at a secondary transfer position, a second image forming unit to form a second image on a separate second image carrier separate from the at least one first color image carrier, the separate second image carrier disposed either upstream or downstream from the secondary transfer position in a direction of conveyance of the recording medium, a direct transfer member to transfer the second image formed on the separate second image carrier directly onto the recording medium at a direct transfer position, a second belt member rotatably extended around multiple roller members to carry the recording medium to the direct transfer position and then to the secondary transfer position, a controller to transfer reference pattern images formed on the at least one first color image carrier and the separate second image carrier onto one of the first belt member and the second belt member, and a first image detector disposed facing one of the first belt member and the second belt member to detect positional deviation of transferred images from the reference pattern images. The controller conveys the reference pattern images to the first image detector, causes the first image detector to detect the reference pattern images, and adjusts one or more image forming conditions of the image forming apparatus to prevent positional deviation of the transferred images from the reference pattern images based on detection results obtained by the first image detector.

The above-described image forming apparatus may further include a first cleaning unit that removes foreign material remaining on the second belt member, and is disposed downstream from a transfer end position in a direction of rotation of the second belt member, the first end portion being one of the direct transfer position and the secondary transfer position, the one of which being disposed downstream from the other in a direction of conveyance of the recording medium. The first image detector may be disposed facing the outer surface of the second belt member, downstream from the transfer end position in a direction of rotation of the second belt member, downstream from a separation position where the recording medium held on the second belt member is separated from the second belt member, and upstream from the first cleaning unit.

The first belt member may include an elastic belt.

The above-described image forming apparatus may further include multiple first color image carriers disposed facing the outer surface of the first belt member, a second cleaning unit to remove foreign material from the first belt member, a contact and separation mechanism to selectively move the first belt member and the second belt member into and out of contact with each other, and a second image detector disposed facing the outer surface of the first belt member, downstream from the secondary transfer position and upstream from the second cleaning unit in a direction of rotation of the first belt member. The reference pattern images may be formed on the multiple first color image carriers and transferred onto the first belt member. The second image formed by the separate second image carrier may be transferred onto the recording medium to form a monochrome image in a monochrome mode of operation of the image forming apparatus. The contact and separation mechanism may separate the first belt member and the second belt member from each other in the monochrome mode. The reference pattern images of the first image may be formed on the multiple first color image carriers to adjust positions of the reference pattern images in a predetermined range on the first belt member and be transferred onto the first belt member. The second image detector may detect the positions of the reference pattern images. The controller may adjust one or more image forming conditions for image transfer onto the multiple first color image carriers based on a detection result obtained by the second image detector.

While reference pattern images transferred on the first belt member are in the secondary transfer position during the monochrome mode, the secondary transfer mechanism may be supplied with a bias charge to form an electric field attracting the reference pattern images electrostatically to the first belt member.

After completion of operation in the monochrome mode and before a start of a subsequent image forming operation with the separate second image carrier and the multiple first color image carriers, the reference pattern images may be formed on both the multiple first color image carriers and the separate second image carrier and are transferred onto the second belt member, the first image detector may detect positions of the reference pattern images on the second belt member, and the controller may adjust the one or more image forming conditions for image transfer onto the multiple first color image carriers and the separate second image carrier based on the detection results obtained by the first image detector.

While the reference pattern images transferred onto the first belt member are in the secondary transfer position during the monochrome mode, the secondary transfer mechanism may be supplied with a bias charge to form an electric field attracting the reference pattern images electrostatically to the first belt member.

The first belt member may include an elastic belt.

A transfer end portion may be one of the direct transfer position and the secondary transfer position, the one of which being disposed downstream from the other in a direction of conveyance of the recording medium. The reference pattern images formed on the at least one first color image carrier and the separate second image carrier may be transferred onto the second belt member. The first image detector may be disposed facing the outer surface of the second belt member, downstream from the transfer end position, and upstream from a separation position where the recording medium held on the second belt member is separated from the second belt member in a direction of rotation of the second belt member.

The first image detector may detect the recording medium when the recording medium passes a position opposite the first image detector. The controller may display an indication of a paper jam when the first image detector detects no passage of the recording medium at a predetermined time.

The first image forming unit and the second image forming unit may form a first toner image and a second toner image on the at least one first color image carrier and the separate second image carrier, respectively. The first image detector may detect an amount of toner on the recording medium. When the amount of toner detected by the first image detector is out of a given reference range, the controller may adjust at least one of the one or more image forming conditions of either the at least one first color image carrier or the separate second image carrier and either the primary transfer member or the secondary transfer mechanism.

The first image forming unit and the second image forming unit may form a first toner image and a second toner image on the at least one first color image carrier and the separate second image carrier, respectively. The first image detector may detect an amount of toner on the recording medium. When the amount of toner detected by the first image detector is out of a given reference range, the controller may adjust at least one of the image forming conditions of either the at least one first color image carrier or the separate second image carrier and either the primary transfer member or the secondary transfer mechanism.

The first belt member may include an elastic belt.

The above-described image forming apparatus may further include cleaning unit to remove foreign material from the first belt member after image transfer. A transfer end portion may be one of the direct transfer position and the secondary transfer position, the one of which being disposed downstream from the other in a direction of conveyance of the recording medium. The reference pattern images formed on the at least one first color image carrier and the separate second image carrier may be transferred onto the second belt member. The first image detector may be disposed facing the outer surface of the first belt member, downstream from the transfer end position and upstream from the cleaning unit in a direction of rotation of the first belt member.

Further in one exemplary embodiment, a control method for the above-described image forming apparatus includes conveying the reference pattern images to the image detector, causing the image detector to detect the reference pattern images, and adjusting one or more image forming conditions of the image forming apparatus to prevent positional deviation of the transferred images from the reference pattern images based on detection results obtained by the image detector.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
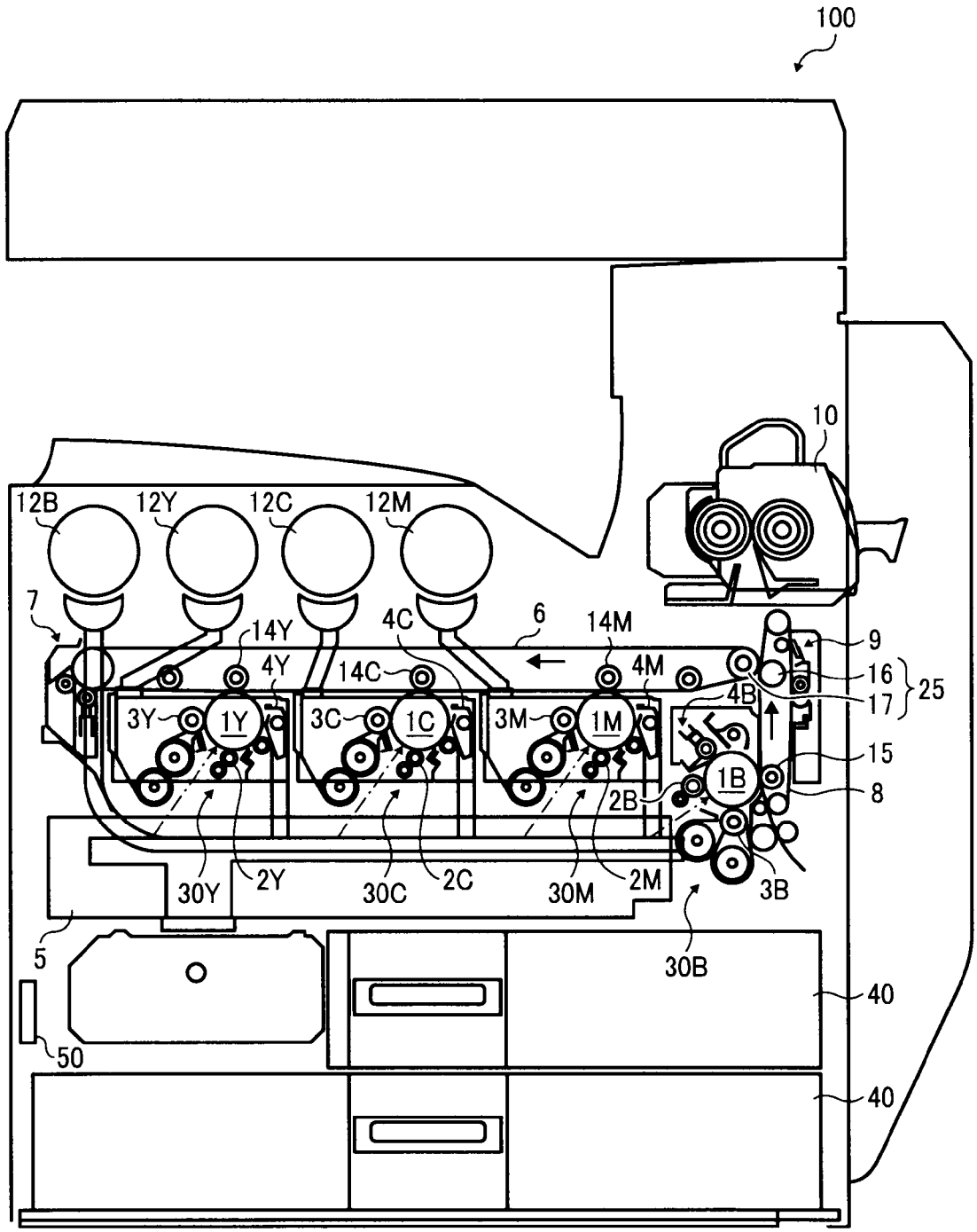
FIG. 1 is a schematic configuration of an image forming apparatus according to an exemplary embodiment of the present invention.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used only to distinguish one element, component, region, layer or section from another region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing exemplary embodiments illustrated in the drawings, specific terminology is employed for the sake of clarity. However, the disclosure of this patent application is not intended to be limited to the specific terminology so selected and it is to be understood that each specific element includes all technical equivalents that operate in a similar manner.

Referring now to the drawings, wherein like reference numerals designate identical or corresponding parts throughout the several views, exemplary embodiments of the present invention are described.

Now, exemplary embodiments of the present invention are described in detail below with reference to the accompanying drawings.

Descriptions are given, with reference to the accompanying drawings, of examples, exemplary embodiments, modification of exemplary embodiments, etc., of an image forming apparatus according to the present invention. Elements having the same functions and shapes are denoted by the same reference numerals throughout the specification and redundant descriptions are omitted. Elements that do not require descriptions may be omitted from the drawings as a matter of convenience. Reference numerals of elements extracted from the patent publications are in parentheses so as to be distinguished from those of exemplary embodiments of the present invention.

The present invention includes a technique applicable to any image forming apparatus. For example, the technique of the present invention is implemented in the most effective manner in an electrophotographic image forming apparatus.

In describing preferred embodiments illustrated in the drawings, specific terminology is employed for the sake of clarity. However, the disclosure of the present invention is not intended to be limited to the specific terminology so selected and it is to be understood that each specific element includes all technical equivalents that operate in a similar manner.

Referring now to the drawings, wherein like reference numerals designate identical or corresponding parts throughout the several views, preferred embodiments of the present invention are described.

FIG. 1 illustrates a schematic configuration of an image forming apparatus 100 according to an exemplary embodiment of the present invention.

The image forming apparatus 100 can be any of a copier, a printer, a facsimile machine, a plotter, and a multifunction printer including at least one of copying, printing, scanning, plotter, and facsimile functions. In this non-limiting exemplary embodiment, the image forming apparatus 100 functions as a full-color printing machine for electrophotographically forming a toner image based on image data on a recording medium (e.g., a transfer sheet).

The toner image is formed with four single toner colors, which are yellow, cyan, magenta, and black. Reference symbols "Y", "C", "M", and "B" represent yellow color, cyan color, magenta color, and black color, respectively.

The image forming apparatus 100 includes four image forming units 30Y, 30C, 30M, and 30B including photoconductors 1Y, 1C, 1M, and 1B, and an intermediate transfer belt 6. The photoconductor 1Y forms yellow (Y) toner image, the photoconductor 1C forms cyan (C) toner image, the photoconductor 1M forms magenta (M) toner image, and the photoconductor 1B forms black (B) toner image. The image forming apparatus 100 shown in FIG. 1 employs a tandem type system in which, in this case, the image forming units 30Y, 30C, and 30M are disposed along the intermediate transfer belt 6 in contact with an outer surface of the intermediate transfer belt 6. The image forming unit 30B of the image forming apparatus 100 is disposed separate from the image forming units 30Y, 30C, and 30M and located upstream from the image forming units 30Y, 30C, and 30M in a direction of conveyance of a transfer sheet. That is, the image forming unit 30B of the image forming apparatus 100 can transfer a black toner image formed thereon onto the transfer sheet directly before a composite toner image of colors other than black is transferred onto the transfer sheet.

The image forming units 30Y, 30C, 30M, and 30B include the photoconductors 1Y, 1C, 1M, and 1B, respectively, charging units 2Y, 2C, 2M, and 2B, respectively, developing units 3Y, 3C, 3M, and 3B, respectively, and cleaning units 4Y, 4C, 4M, and 4B, respectively. An optical writing unit 5 is disposed below the image forming units 30Y, 30C, 30M, and 30B.

The photoconductors 1Y, 1C, 1M, and 1B are drum-shaped image carriers and rotate in a clockwise direction in FIG. 1.

The charging units 2Y, 2C, 2M, and 2B, the optical writing unit 5, the developing units 3Y, 3C, 3M, and 3B, and the cleaning units 4Y, 4C, 4M, and 4B are disposed in this order around the photoconductors 1Y, 1C, 1M, and 1B, respectively, so that the image forming units 30Y, 30C, 30M, and 30B can form respective single color toner images.

The charging units 2Y, 2C, 2M, and 2B uniformly charge respective surfaces of the photoconductors 1Y, 1C, 1M, and 1B.

The optical writing unit 5 emits laser light beams to the photoconductors 1Y, 1C, 1M, and 1B in the identical direction to each other so as to avoid the complexity or intersection of light paths of the laser light beams. The optical writing unit 5 irradiates the respective surfaces of the photoconductors 1Y, 1C, 1M, and 1B so as to form electrostatic latent images on the respective surfaces of the photoconductors 1Y, 1C, 1M, and 1B. The emitting system of the optical writing unit 5 is not limited to a laser system but can include a LED system.

The developing units 3Y, 3C, 3M, and 3B develop the respective electrostatic latent images into visible toner images.

The cleaning units 4Y, 4C, 4M, and 4B clean the respective surfaces of the photoconductors 1Y, 1C, 1M, and 1B by removing residual toner remaining on the respective surfaces of the photoconductors 1Y, 1C, 1M, and 1B. Each of the cleaning units 4Y, 4C, 4M, and 4B of the image forming apparatus 100 includes a blade-type cleaning member. However, the cleaning member of the present invention is not limited to the blade-type cleaning member but can include a brush-type cleaning member such as a fur brush roller and a magnetic brush roller.

The photoconductors 1Y, 1C, 1M, and 1B, the charging units 2Y, 2C, 2M, and 2B, the developing units 3Y, 3C, 3M, and 3B, and the cleaning units 4Y, 4C, 4M, and 4B are respectively integrally included in the image forming units 30Y, 30C, 30M, and 30B, respectively.

Scanned data of image read by a scanner, received data read by a facsimile machine, or color image data transmitted from an external computer is developed with respective toners of complementary colors in a color separation technique and data of respective single color images are formed. Then, the data is transmitted to the optical writing unit 5. The optical writing unit 5 exposes the respective single color images formed on the uniformly charged surfaces of the photoconductors 1Y, 1C, 1M, and 1B, and the developing units 3Y, 3C, 3M, and 3B form respective visible toner images with respective color toner.

The respective color toner images formed on the surfaces of the photoconductors 1Y, 1C, and 1M that serve as first color image carriers are sequentially transferred onto an outer surface of the intermediate transfer belt 6 that serves as an intermediate transfer member or a first belt member so that a three-color toner image can be formed.

The black toner image formed on the surface of the photoconductor 1B that serves as a separate second image carrier is transferred directly onto a recording medium that is conveyed by a recording medium conveyance belt 8 that serves as a second belt member. Thereafter, the three-color toner image is transferred onto the recording medium by overlaying the black image previously formed thereon.

A sheet feed tray 40 accommodates recording media including the recording medium on which an output image is formed. The recording medium is fed from the sheet feed tray 40 by a sheet feed roller, not shown, toward the recording medium conveyance belt 8 to be conveyed by an outer surface of the recording medium conveyance belt 8 that forms an endless loop.

A direct transfer roller 15 that serves as a direct transfer member is disposed facing the photoconductor 1B via the recording medium conveyance belt 8. A direct transfer nip portion is formed between the photoconductor 1B and the direct transfer roller 15 via the recording medium conveyance belt 8.

The direct transfer roller 15 is applied with a voltage having a polarity that is opposite the toner used in the image forming apparatus 100. The voltage functions at the direct transfer nip portion to transfer the black image formed on the surface of the photoconductor 1B onto the recording medium that is held between the photoconductor 1B and the recording medium conveyance belt 8.

In FIG. 1, the image forming units 30Y, 30C, and 30M are disposed along the intermediate transfer belt 6. Primary image transfer rollers 14Y, 14C, and 14M are disposed via the intermediate transfer belt 6 slightly downstream from the photoconductors 1Y, 1C, and 1M provided to the image forming units 30Y, 30C, and 30M, respectively, in a direction of rotation of the intermediate transfer belt 6.

The primary image transfer rollers 14Y, 14C, and 14M, each of which serving as a primary transfer member, are also applied with a high voltage having a polarity opposite the toner. The voltage forms an electric field to sequentially transfer the single color toner images formed on the respective surfaces of the photoconductors 1Y, 1C, and 1M onto the outer surface of the intermediate transfer belt 6 to form the three-color toner image of the yellow, cyan, and magenta images.

The three-color toner image formed on the intermediate transfer belt 6 is transferred by the voltage applied to a secondary image transfer nip portion formed between a secondary image transfer roller 16 and a belt supporting roller 17, which extends the intermediate transfer belt 6 and is disposed facing the secondary image transfer roller 16, via the intermediate transfer belt 6 onto the recording medium conveyed to the secondary image transfer nip portion. At this time, the high voltage having a polarity opposite the toner charge polarity can be applied to the secondary image transfer roller 16 or the high voltage having a polarity same as the toner charge polarity to the belt supporting roller 17.

When the high voltage having a polarity opposite the toner charge polarity is applied to the secondary image transfer roller 16, a high voltage power source for applying the voltage to the direct transfer roller 15 can be used. Therefore, a separate, dedicated power source for applying a voltage to the secondary image transfer roller 16 is not necessary, resulting in cost reduction and side reduction of the image forming apparatus 100.

When the high voltage having a polarity same as the toner charge polarity to the belt supporting roller 17, the voltage is applied to the toner via the intermediate transfer belt 6. This application of high voltage to the toner can achieve a good transferability even when the reading medium includes moisture to cause low resistance thereof.

The secondary image transfer roller 16, the belt supporting roller 17, and the power source to apply the high voltages thereto form a secondary image transfer mechanism 25 that serves as a secondary transfer mechanism.

Thus, the full-color toner image of the yellow, cyan, magenta, and black image is formed on the recording medium. As the recording medium having the full-color toner image thereon travels, the recording medium reaches a roller member extending the recording medium conveyance belt 8 at a downstream side from the secondary image transfer nip portion in a direction of rotation of the recording medium conveyance belt 8. According to the curvature of the roller member, the recording medium is separated from the recording medium conveyance belt 8 with the elasticity of the recording medium at a curved section at which the direction of rotation of the recording medium conveyance belt 8 is sharply changed.

Then, the recording medium is conveyed to a fixing unit 10. The fixing unit 10 fixes the full-color toner image to the recording medium to form a color image on the recording medium.

The black image is transferred directly onto the recording medium in this exemplary embodiment. The direct image transfer of black toner can reduce image forming components and can write the electrostatic latent image for black image in a same direction as the electrostatic latent images for yellow, cyan, and magenta images.

Further, by transferring the black image formed on the photoconductor 1B of the black image forming unit 30B directly onto the recording medium, high transfer efficiency can be obtained in comparison with an image transfer in which the yellow, cyan, magenta, and black toner images are transferred from the photoconductors 1Y, 1C, 1M, and 1B onto the recording medium via the intermediate transfer belt 6.

Therefore, compared to an indirect image transfer of black toner via the intermediate transfer belt 6, the direct image transfer of black toner can reduce an amount of consumption of black toner when forming a black image on the surface of the photoconductor 1B of the image forming unit 30B.

However, the image transfer method of the image forming apparatus 100 is not limited to the direct image transfer but can be an indirect image transfer of black toner from the photoconductor 1B onto the recording medium via an intermediate transfer member such as an intermediate transfer belt that is different from the intermediate transfer belt 6 and an intermediate transfer drum.

In this case, the electrostatic latent image emitted by the optical writing unit 5 for black image may be a mirror image or an opposite image to the electrostatic latent images for yellow, cyan, and magenta images, causing complex writing control.

The description above is an image forming operation with full-color mode for forming a full-color image of yellow toner image, cyan toner image, magenta toner image, and black toner image on a recording medium. The image forming apparatus 100 according to an exemplary embodiment of the present invention also has a monochrome mode to form a monochrome image or a black-and-white image on a recording medium is included. When forming monochrome images with the monochrome mode, the optical writing unit 5 exposes an image area on the surface of the photoconductor 1B for forming an electrostatic latent image of black image according to data of scanned image read by the scanner, data received by the facsimile machine, or image data transmitted from an external computer. Then, the developing unit 3B develops the electrostatic latent image into a visible image with black toner. The black image formed on the surface of the photoconductor 1B is transferred directly onto the recording medium conveyed by the recording medium conveyance belt 8. The fixing unit 10 then fixes the black image to the recording medium. Thus, a monochrome image is formed and output.

Further, in the monochrome mode, the intermediate transfer belt 6 and the recording medium conveyance belt 8 forming the secondary image transfer nip portion therebetween contact and separate from each other by a contact and separation mechanism, not shown. With the contact and separation mechanism, the image forming units 30Y, 30C, and 30M and the intermediate transfer belt 6 may not operate during the image forming operation with the monochrome mode, which does not affect production of a monochrome image. The suspension of operation of the image forming units 30Y, 30C, and 30M and the intermediate transfer belt 6 can avoid unnecessary operation thereof in the image forming operation in the monochrome mode, which can prevent degradation of the image forming units 30Y, 30C, and 30M and the intermediate transfer belt 6 and can provide an extended period of life thereof.

Further, the image forming apparatus 100 according to this exemplary embodiment further includes an optical sensor 11 and a controller 50.

The optical sensor 11 that serves as a first image detector is disposed downstream from a transfer end portion where the image transfer of the four-color toner image is completed in a direction of rotation of the recording medium conveyance belt 8 or in a direction of rotation of the intermediate transfer belt 6. The optical sensor 11, details of which will be described later, is disposed facing the outer surface of the recording medium conveyance belt 8 that forms an endless loop or facing the outer surface of the intermediate transfer belt 6.

The controller 50 includes a CPU and memory units for performing various controls in a main body of the image forming apparatus 100. The controller 50 is connected to various units provided in the main body of the image forming apparatus 100. However, detailed descriptions and illustration of wiring for connection to the units are omitted.

The controller 50 performs process controlling between the recording media and transfers pattern images for measuring density of the images formed on the photoconductors 1Y, 1C, 1M, and 1B onto the recording medium conveyance belt 8 or the intermediate transfer belt 6. The optical sensor 11 detects the image density with reflective light. Based on the detection results obtained by the optical sensor 11, the controller 50 adjusts image forming conditions to maintain an appropriate density of the image formed on the recording medium.

Further, the controller 50 forms pattern images for detecting positional deviation on the recording medium conveyance belt 8 or on the intermediate transfer belt 6, so that the optical sensor 11 can detect the pattern images. With this operation, respective amounts of positional deviation between the yellow, cyan, magenta, and black images. Based on the detection results of the optical sensor 11, the controller 50 can adjust the positional relations and image forming conditions of yellow, cyan, magenta, and black images, thereby accurately positioning the respective single color images.

Figure 2:
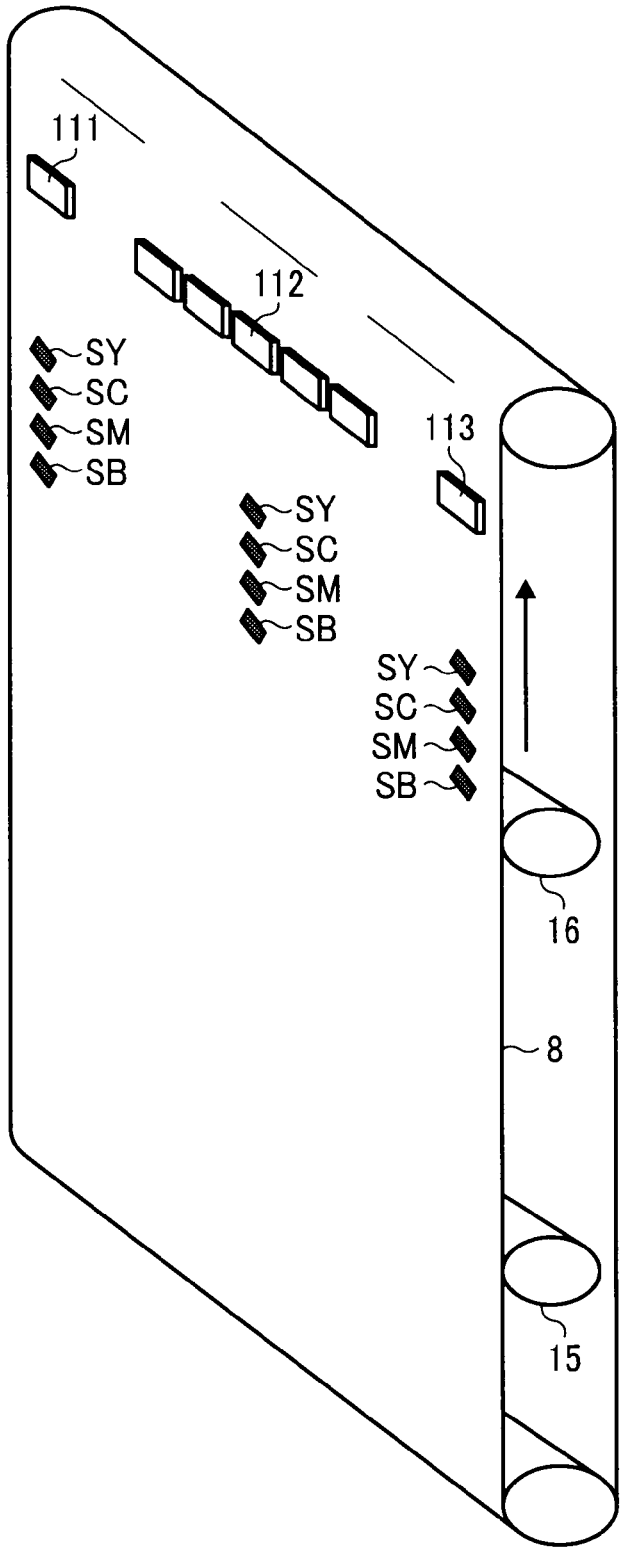
FIG. 2 is a perspective view of pattern images formed on an image conveyance belt of the image forming apparatus of FIG. 1.

For example, pattern images for registration skew detection are formed on both ends and a center in a widthwise direction of the recording medium conveyance belt 8 are formed as shown in FIG. 2. Three sets of pattern images formed on the both ends and center of the recording medium conveyance belt 8 include four color reference toner images SY, SC, SM, and SB of yellow, cyan, magenta, and black arranged at predetermined intervals in a sub-scanning direction. Reference toner images of same color are arranged in a main scanning direction.

In FIG. 2, reference toner images in the pattern images that are formed at one end in a widthwise direction of the recording medium conveyance belt 8 and located near from a front side of the image forming apparatus 100 are detected by a first end optical sensor 111. Reference toner images in the pattern images that are formed at the center in a widthwise direction of the recording medium conveyance belt 8 are detected by a center optical sensor 112. Reference toner images in the pattern images that are formed at the other end in a widthwise direction of the recording medium conveyance belt 8 and located far from the front side of the image forming apparatus 100 are detected by a second end optical sensor 113.

If image forming timings of reference toner images of respective colors are appropriate to each other, the intervals of detection of the reference toner images can be equal to each other. By contrast, if the image forming timings thereof are not appropriate, the intervals of image formation of the reference toner images may vary and become different from each other, which can cause different intervals of detection thereof.

Further, when no skew occurs when optical components optically write the reference toner images, the reference toner images of same color can be detected at the same timing between the three sets of pattern images. However, when skew is generated, the detection timings may vary.

The controller in the main body of the image forming apparatus 100 adjusts the start timing of optical writing performed by the optical writing unit 5 and the inclination of optical mirrors, based on deviation of the intervals and timings of detection of respective color toner images in the main scanning direction and the sub-scanning direction. With this operation, color misregistration and image skew can be prevented.

In comparison with monochrome image forming apparatuses, electrophotographic color image forming apparatuses uses multiple colors of toner to output an image of a document with a large image area ratio such as a photo image. Therefore, toner recycling has been a critical issue from the viewpoint of a recent trend of conserving resources and reducing space and running cost.

Regarding toner recycling, the electrophotographic color image forming apparatuses form respective color images on corresponding image carriers and transfer the respective color images onto a transfer member to sequentially overlay directly or via an intermediate transfer member. In this system, it is unavoidable that some toner particles on the color images remain on the image carriers after image transfer. The residual toner remaining on each of the image carriers can be removed and collected by a cleaning unit provided in the vicinity of each of the image carriers.

In fact, there are some problems in recycling of residual toner. One of the problems is that mixing of toner colors occur during an image transfer process, in which an upstream-side toner image transferred on a recording medium is conveyed to a downstream-side toner image to be overlaid with the downstream-side toner image on the recording medium.

To accomplish such recycling, in a tandem-type image forming apparatus that incorporates separate image carriers corresponding to each toner color, a cleaning unit is provided for removing toner from each image carrier. With this configuration, it is easy to collect and return the residual toner to a developing unit of each toner color for recycling for image formation.

Since the respective image forming units are independent of each other, in theory the tandem-type image forming apparatus as described above should have no mixing of toner colors in the collected toner. However, mixing of toner colors can occur during the image transfer process, in which a toner image is transferred from an image carrier onto a recording medium.

There are several reasons for such mixing of toner of different colors. For example, when forming an overlaid color toner image in a tandem-type image forming apparatus, a first toner image formed on a first image carrier is transferred onto a recording medium conveyed by a sheet transfer member, then a second toner image formed on a second image carrier disposed downstream from the first image carrier is overlaid on the first toner image on the recording medium, and this operation is repeated until a toner image formed on an image carrier farthest downstream is transferred onto the recording medium.

When the downstream-side toner image is transferred onto the recording medium, the toner on the upstream-side toner image that is already carried on the recording medium can reversely be transferred onto the surface of the downstream-side image carrier and is then collected by a cleaning unit for the downstream-side toner. Thus, the upstream-side toner and the downstream-side toner are mixed together. In other words, the first toner carried by a recording medium is reversely transferred onto a second image carrier and is collected by a second cleaning unit. The mixing of toners can also occur in the related-art image forming apparatus with the intermediate transfer system including the intermediate transfer member.

Consequently, when the related-art color image forming apparatus causes toner of each image carrier to be collected and returned to a corresponding developing unit for the purpose of recycling, hue of toner in the developing unit gradually but largely changes, becoming increasingly mixed with time.

Various techniques for known image forming apparatuses have been proposed to eliminate the above-described problem.

In one example of a known technique disclosed in Japanese Patent Laid-open Application No. 2002-357938, a black image carrier is located at an extreme upstream side or a first position in an order of image transfer, so that black toner collected from the black image carrier does not get mixed with other colors and can be conveyed to a corresponding developing unit for recycling.

In another example of a known technique disclosed in Japanese Patent No. 3366969, toner of mixed color is mixed with black toner to be used as black toner.

Yet another example of a known technique disclosed in Japanese Patent Laid-open Application No. 2002-365995 has a configuration in which collected toner can be selectively used or entirely discarded.

Further, yet another example of known techniques disclosed in Japanese Patent Laid-open Application No. 2000-035703 and Japanese Patent Laid-open Application No. 2006-030519 includes a developing unit only for mixed toner.

At present, image forming apparatuses capable of producing color images currently on the market are used at a rate of 70% to 80% to produce monochrome (black-and-white) images. Since black toner is consumed when producing full-color image as well as monochrome image, a relatively large proportion of waste toner consists of black toner. Therefore, even when color toners other than black toner are discarded while the black toner is collected for reuse, in effect substantially all collected toner is not discarded but is practically reused.

However, as disclosed in Japanese Patent Laid-open Application No. 2002-357938, an image forming unit for forming black images, together with a corresponding developing unit are disposed at a far upstream side in a direction of rotation of an intermediate transfer belt, and therefore of image carriers of respective colors are located farthest from a transfer position where a toner image formed on the outer surface of the intermediate transfer belt is transferred onto a transfer sheet as a recording medium.

Because of the above-described location of the image carrier for black image within the array of image carriers, even though formation of monochrome or black images is the most common of all image forming operations of apparatuses currently on the market, additional time is needed from development of the black image to transfer of the black image onto a recording medium or a transfer sheet. Therefore, not only does a user have to wait from execution of a printing request to completion of printout of the transfer sheet, but also the image forming carriers of the image forming apparatus disclosed in Japanese Patent Laid-open Application No. 2002-357938 are required to keep idling. In particular, the idling of units unnecessary for forming black images, i.e., the image forming carriers of the image forming apparatus disclosed in Japanese Patent Laid-open Application No. 2002-357938 can accelerate wear of parts and components used during the idling of the image forming carriers and shorten the useful life period of the parts and components.

In the image forming apparatus disclosed in Japanese Patent No. 3366969, the mixing of toner of different colors in the collected toner is controlled to remain at or below a predetermined level for recycling in a developing unit for black toner. However, the mixed toner can change the color tone of black toner and degrade the quality of a printed image.

In the image forming apparatus disclosed in Japanese Patent Laid-open Application No. 2002-365995, whether to reuse or discard the collected toner is determined by switching a direction of rotation of toner conveyance screws disposed within the individual units. Since a cleaning unit of the related-art image forming apparatus contains mixed toner, even if an amount of toner used for forming each image is obtained by counting the pixels, the calculation actually results in an integral value, making it difficult to accurately estimate the degree of mixed toner in the collected toner.

In the image forming apparatuses disclosed in Japanese Patent Laid-open Application No. 2000-035703 and Japanese Patent Laid-open Application No. 2006-030519, a dedicated developing unit dedicated to mixed toner and a dedicated image carrier are incorporated. Consequently, the number of units increases, which can lead to an increase in size of the known image forming apparatus and an increase in manufacturing costs of the known image forming apparatus.

Further in an image forming apparatus Japanese Patent Laid-open Application No. 10-020627, one conveyance path is dedicated to a monochrome image forming process, another conveyance path is dedicated to a full-color image forming path, and only a sheet feed device and a fixing unit can use the two conveyance paths in common. However, if the above-described system is employed, the image forming apparatus increases in size and makes the conveyance paths complicated. Further, different black image forming processes are required for the monochrome image forming process and the full-color image forming process. These inconveniences can cause an increase in cost severely.

The image forming apparatus 100 according to this exemplary embodiment employs a tandem-type image forming system in which the three image forming units 30Y, 30C, and 30M are aligned along the intermediate transfer belt 6. The image forming unit 30B included in the image forming apparatus 100 is disposed separate from the image forming units 30Y, 30C, and 30M and upstream therefrom in a direction of movement of a recording medium.

Since the image forming unit 30B of the image forming apparatus 100 according to this exemplary embodiment is disposed separate from the image forming units 30Y, 30C, and 30M, yellow, cyan, and magenta toners may not be reversely transferred and mixed with black toner in the black image forming process. Therefore, the toner collected from the photoconductor 1B is conveyed via a black toner collection path, not shown, to the developing unit 3B so as to be reused. A paper dust removing unit and/or a switching unit to switch the direction of the collected toner to a toner discarding path can be provided in the black toner collection path.

The image forming apparatus 100 of FIG. 1 further includes an intermediate transfer belt cleaning unit 7 and a recording medium conveyance belt cleaning unit 9, and toner containers 12Y, 12C, 12M, and 12B.

The intermediate transfer belt cleaning unit 7 that serves as a cleaning unit or a second cleaning unit removes residual toner and materials remaining on the outer surface of the intermediate transfer belt 6.

The recording medium conveyance belt cleaning unit 9 that serves as a first cleaning unit removes residual toner and materials remaining on the outer surface of the recording medium conveyance belt 8.

The toner containers 12Y, 12C, 12M, and 12B contain respective color toners therein.

Further, in the image forming apparatus 100 according to this exemplary embodiment, the secondary image transfer nip portion is disposed downstream from the direct transfer nip portion in a direction of conveyance of the recording medium. By contrast, it is more likely that the color toner is mixed with the black toner when the secondary image transfer nip portion is disposed upstream from the direct transfer nip portion in the direction of conveyance of the recording medium. However, this configuration is also acceptable to the image forming apparatus 100 of FIG. 1.

Example Configuration 1

Figure 3:
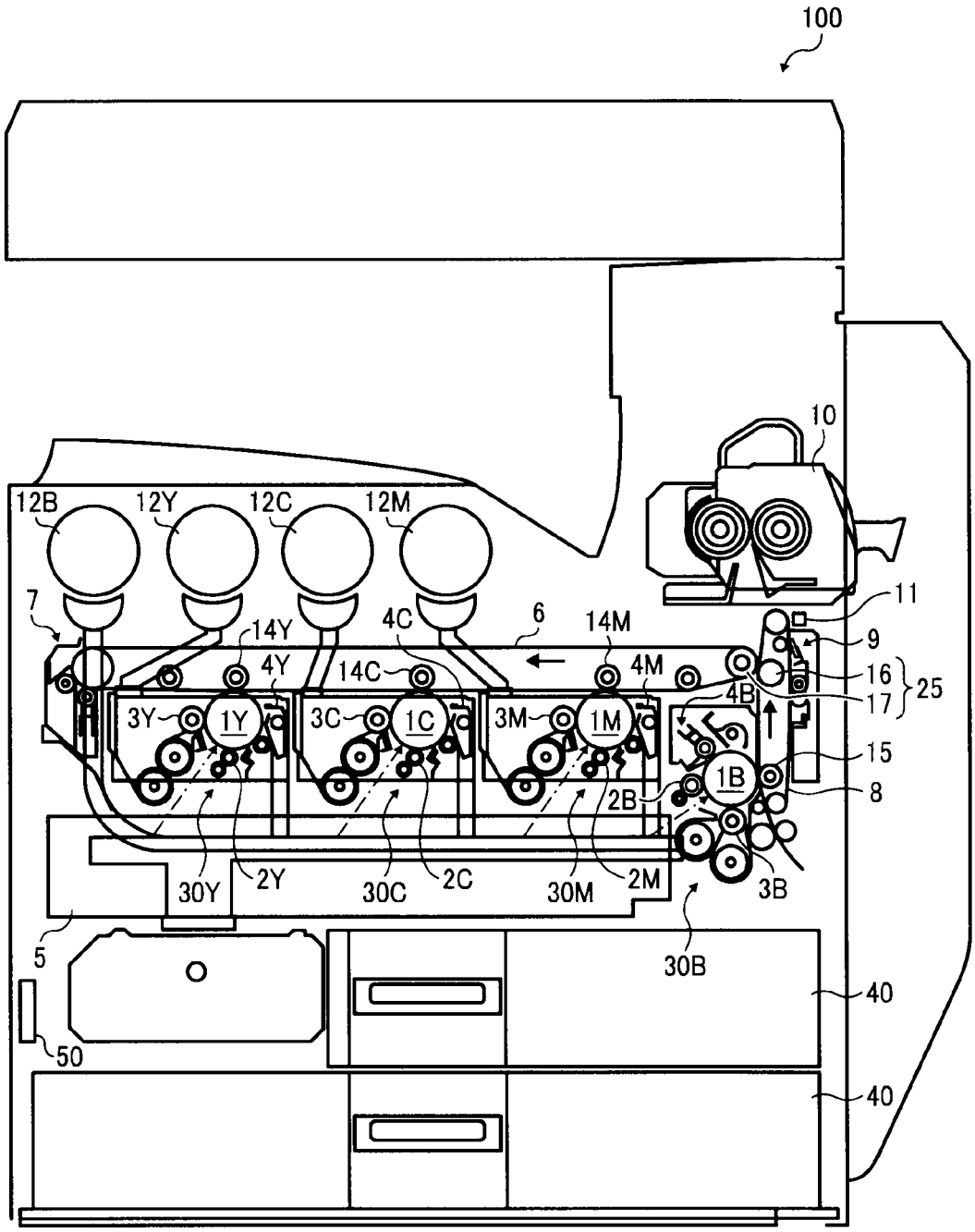
FIG. 3 is a schematic configuration of an image forming apparatus according to Example 1 of the image forming apparatus of FIG. 1.

FIG. 3 illustrates an example configuration of the image forming apparatus 100, which is hereinafter referred to as Example Configuration 1.

As shown in Example Configuration 1 of FIG. 3, a optical sensor 11 is disposed facing the outer surface of the recording medium conveyance belt 8 in a range of from a separation position where the recording medium is separated from the recording medium conveyance belt 8 to an arranging position of the recording medium conveyance belt cleaning unit 9 in a direction of rotation of the recording medium conveyance belt 8.

The above-described pattern images are formed on the photoconductors 1Y, 1C, 1M, and 1B and transferred onto the recording medium conveyance belt 8. Then, the pattern images formed on the recording medium conveyance belt 8 are detected by the optical sensor 11.

The image forming apparatus 100 of Example Configuration 1 further includes a unit case, not shown, to support the recording medium conveyance belt 8. The unit case is disposed in a region from where the image forming units 30Y, 30C, 30M, and 30B are installed to where the recording medium with a toner image formed thereon is conveyed. Therefore, scattered toner particles may not enter to an area from the separation position of the recording medium to the arranging position of the recording medium conveyance belt cleaning unit 9 in a direction of rotation of the transfer conveyance belt 8, and the photoconductors 11Y, 11C, 11M, and 11B may not be contaminated easily.

Further, as shown in FIG. 3, the optical sensor 11 is disposed facing a roller that extends the recording medium conveyance belt 8 in a direction or rotation thereof. By so doing, according to the detection results of the optical sensor 11, noise due to vibration caused by the rotation of the recording medium conveyance belt 8 can be reduced and can obtain more accurate detection results.

Example Configuration 2

Figure 4:
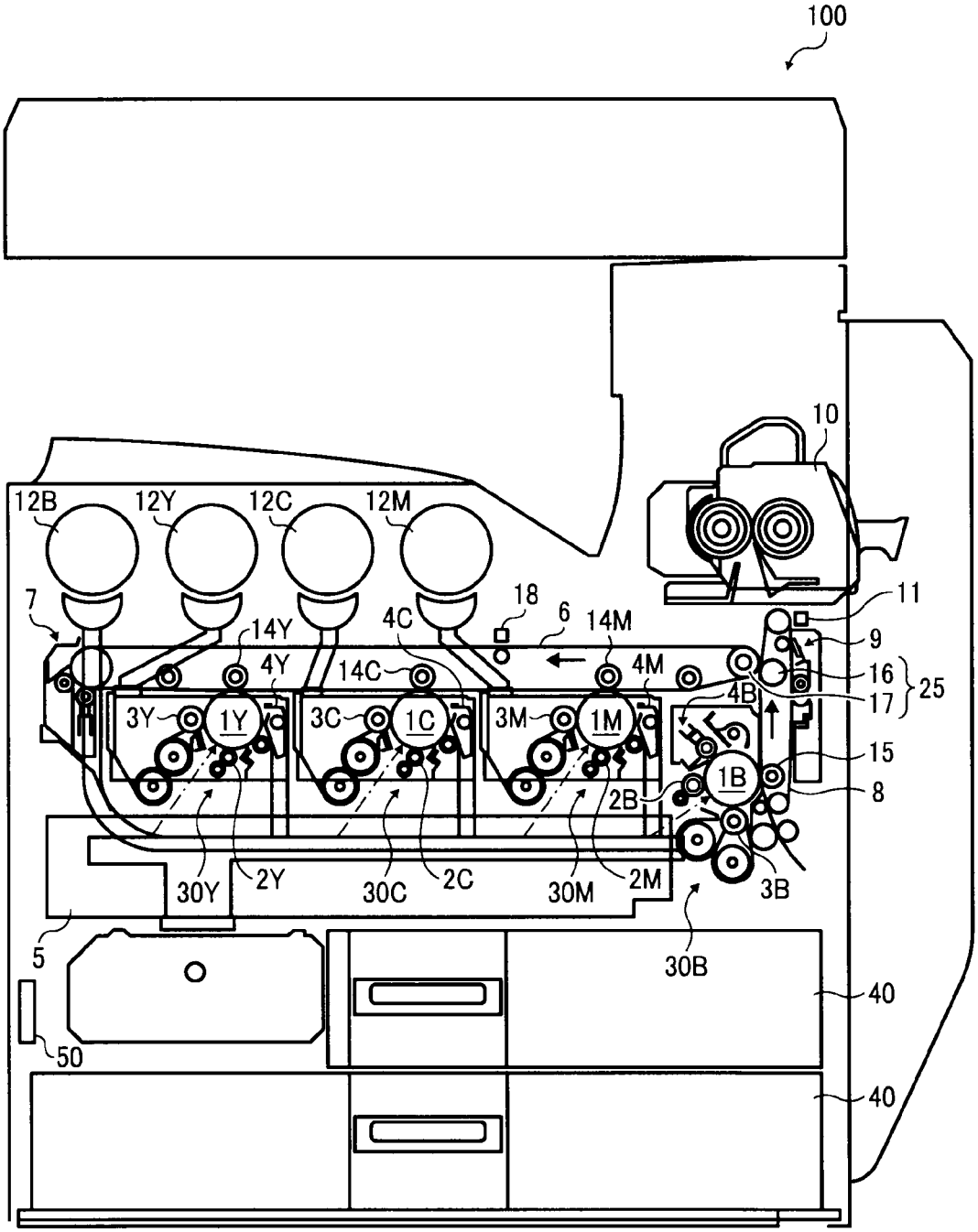
FIG. 4 is a schematic configuration of an image forming apparatus according to Example 2 of the image forming apparatus of FIG. 1.

FIG. 4 illustrates another example configuration of the image forming apparatus 100, which is hereinafter referred to as Example Configuration 2.

As shown in Example Configuration 2 of FIG. 4, the optical sensor 11 is disposed facing the outer surface of the recording medium conveyance belt 8 in a range of from a separation position where the recording medium is separated from the recording medium conveyance belt 8 to an arranging position of the recording medium conveyance belt cleaning unit 9 in a direction of rotation of the recording medium conveyance belt 8, which is same as the configuration in Example Configuration 1.

Different from Example Configuration 1, the image forming apparatus 100 shown in FIG. 4 according to Example Configuration 2 further includes a photoconductor 18. The photoconductor 18 is disposed facing the outer surface of the intermediate transfer belt 6 in a range of from the secondary image transfer nip portion to an arranging position of the intermediate transfer belt cleaning unit 7 in a direction of rotation of the intermediate transfer belt 6.

Further, in the configuration of Example Configuration 2, the image forming apparatus 100 further includes a contact and separation mechanism 20.

The contact and separation mechanism 20 contacts and separates the intermediate transfer belt 6 and the recording medium conveyance belt 8 in a region of the secondary image transfer mechanism 25 or in a region in which the components and unit forming the secondary image transfer mechanism 25 are disposed and operate. The contact and separation mechanism 20 is not limited to but includes a configuration shown in FIG. 5.

Figure 5:
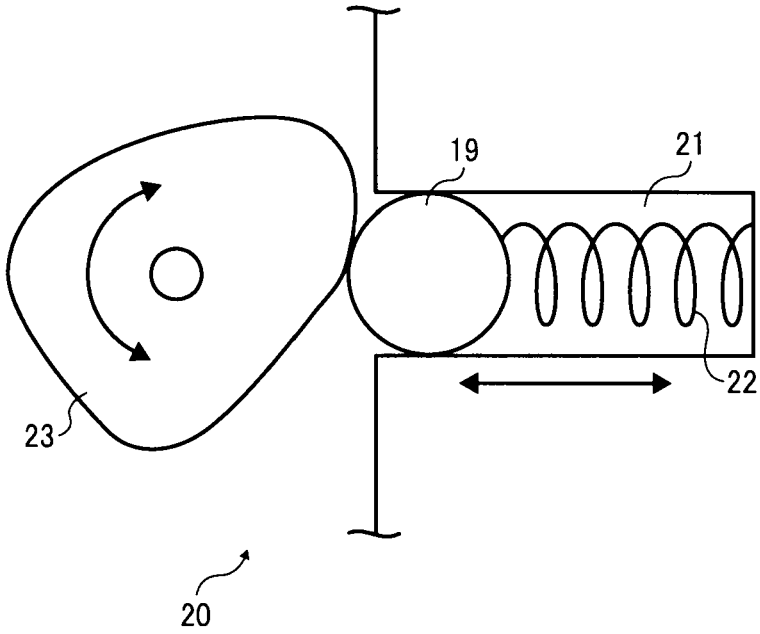
FIG. 5 is an example of a contact and separation mechanism incorporated in the image forming apparatus of FIG. 1.

In the configuration of the contact and separation mechanism 20 shown in FIG. 5, a shaft 19 of the secondary image transfer roller 16 is inserted into a groove 21 that is formed in a wall of the main body of the image forming apparatus 100 so as to press against a cam 23 with a spring 22. By rotating the cam 23 by a pulse motor, not shown, the contact and separation mechanism 20 can move the intermediate transfer belt 6 and the recording medium conveyance belt 8 into and out of contact with each other.

Figure 6:
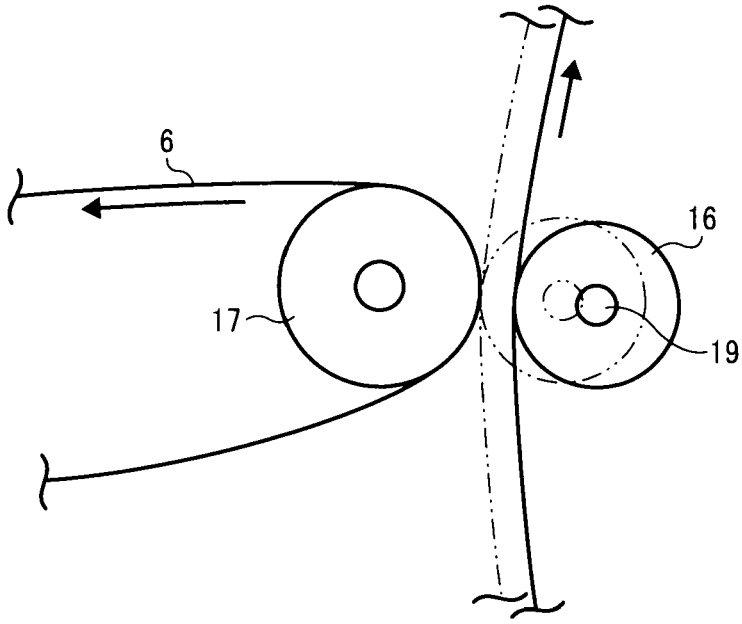
FIG. 6 is a diagram illustrating a status in which an intermediate transfer belt and the image conveyance belt are separated according to action of the contact and separation mechanism of FIG. 5.

When separating the intermediate transfer belt 6 from the recording medium conveyance belt 8 in the region of the secondary image transfer mechanism 25, the cam 23 is rotated in a clockwise direction in FIG. 5. By so doing, the shaft 19 of the secondary image transfer roller 16 moves in the groove 21 against the biasing force exerted by the spring 22, so that the secondary image transfer roller 16 can be moved away to separate from the belt supporting roller 17. With this configuration, the secondary image transfer roller 16 and the belt supporting roller 17 held in contact with each other via the intermediate transfer belt 6 and the recording medium conveyance belt 8 are separated from each other. Thus, by separating the secondary image transfer roller 16 and the belt supporting roller 17 from each other, the recording medium conveyance belt 8 uses its own tension force to move away from the intermediate transfer belt 6 as the belt supporting roller 17 changes its position. By so doing, as shown in FIG. 6, the intermediate transfer belt 6 and the recording medium conveyance belt 8 are separated from each other.

Further, when contacting the intermediate transfer belt 6 and the recording medium conveyance belt 8 that are separated from each other in the region of the secondary image transfer mechanism 25, the cam 23 is rotated in a counterclockwise direction in FIG. 5. By so doing, the shaft 19 of the secondary image transfer roller 16 moves in the groove 21 to the biasing force exerted by the spring 22, so that the secondary image transfer roller 16 can be moved closer to contact with the belt supporting roller 17. With this construction, as the secondary image transfer roller 16 moves to the belt supporting roller 17, the recording medium conveyance belt 8 moves close to the intermediate transfer belt 6. Thus, by contacting the secondary image transfer roller 16 and the belt supporting roller 17 to each other via the recording medium conveyance belt 8 and the intermediate transfer belt 6, the intermediate transfer belt 6 and the recording medium conveyance belt 8 contact to each other.

Figure 7:
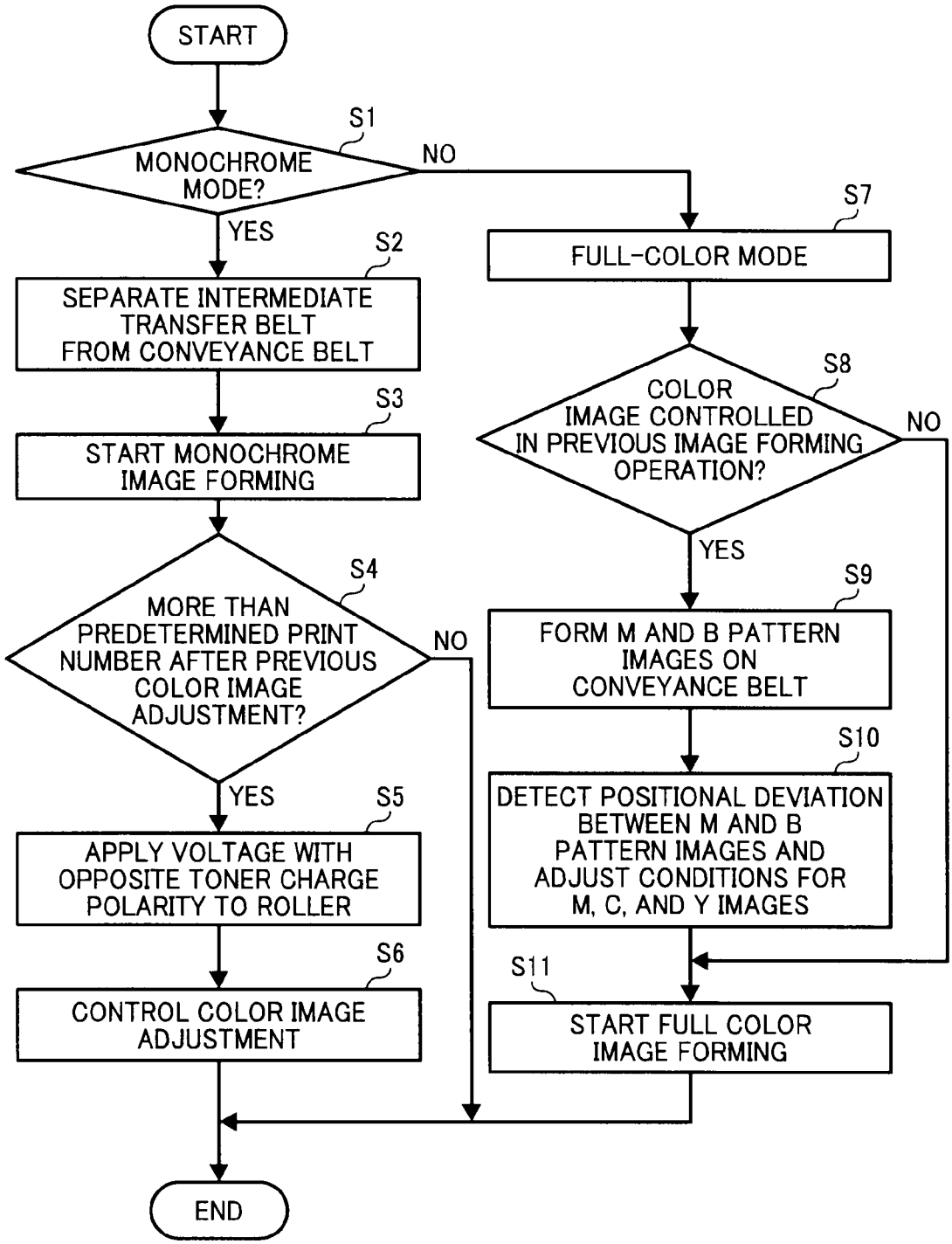
FIG. 7 is a flowchart of an example control operation performed by the image forming apparatus according to Example 2.

FIG. 7 is a flow chart explaining image forming operations when either one of the monochrome mode or the color mode is selected.

As shown in the flow chart of FIG. 7 for explaining image forming processes of the image forming apparatus 100 according to this exemplary embodiment of the present invention, the controller 50 determines whether the monochrome mode is selected or not in step S1.

When the monochrome mode is not selected, the result of step S1 is NO, and the process proceeds to step S7, which is described later.

When the monochrome mode is selected, the result of step S1 is YES, and the process proceeds to step S2.

In step S2, the contact and separation mechanism 20 separates the intermediate transfer belt 6 from the recording medium conveyance belt 8, and in step S3, the monochrome image forming can be started.

In Example Configuration 2, while the monochrome image is being formed, correction pattern images for yellow, cyan, and magenta toners are formed on the intermediate transfer belt 6 so as to adjust the positional deviation and image densities between the respective color images (yellow, cyan, and magenta images). Such color image adjustment controls are not necessary to perform each time the monochrome mode is executed. As shown in step S4, the controller 50 provided in the main body of the image forming apparatus 100 determines whether a predetermined number of prints has been output after the previous color image adjustment control. The above-described controls can be performed when the controller 50 determines that the predetermined number of prints has been output after the previous color image adjustment control.

Further, when the contact and separation mechanism 20 performs contact and separation operations between the intermediate transfer belt 6 and the recording medium conveyance belt 8, it is desired that the distance of contact and separation therebetween is smaller because the change of the conveyance path of the recording medium by the recording medium conveyance belt 8 may be smaller. However, when the distance of contact and separation between the intermediate transfer belt 6 and the recording medium conveyance belt 8 is small, it is likely that color images (yellow, cyan, and magenta pattern images) are transferred onto a recording medium or the recording medium conveyance belt 8 with a monochrome or black-and-white image formed thereon in the region of the secondary transfer unit because the color images (yellow, cyan, and magenta pattern images) for the above-described color image adjustment control are formed on the intermediate transfer belt 6 and the monochrome (black-and-white) image transferred onto the recording medium is conveyed by the recording medium conveyance belt 8. Therefore, it is preferable to apply a bias to the secondary image transfer mechanism 25 so as to generate an electric field in which the color images (yellow, cyan, magenta pattern images) formed on the intermediate transfer belt 6 are electrostatically attracted to the intermediate transfer belt 6. For example, it is preferable to apply a high voltage having a polarity opposite the toner charge polarity to the belt supporting roller 17 of the secondary image transfer mechanism 25. With this operation, the color images (yellow, cyan, magenta pattern images) formed on the intermediate transfer belt 6 can be prevented from being transferred onto the recording medium or onto the recording medium conveyance belt 8 with the monochrome image thereon in the region of the secondary image transfer mechanism 25.

Therefore, when the controller 50 determines that the predetermined number of prints has been output after the previous color image adjustment control, the result of step S4 is YES, and the process proceeds to step S5 followed by step S6.

In step S5, the controller 50 applies the voltage having a polarity opposite the toner charge polarity to the belt supporting roller 17. In Example Configuration 2, the toner charge polarity corresponds to a minus (negative) polarity and the amount of voltage applied to the belt supporting roller 17 is in a range of from 500V to 2,000V.

Then, in step S6, the controller 50 controls the above-described color image adjustment.

When controller 50 determines that the predetermined number of prints has not yet been output after the previous color image adjustment control, the result of step S4 is NO, and the controller 50 may neither apply the voltage having a polarity opposite the toner charge polarity to the belt supporting roller 17 nor control the color image adjustment.

As previously described, when the monochrome mode is not selected, the result of step S1 is NO, and the process proceeds to step S7.

In step S7, the controller 50 enters the full-color mode, and the process proceeds to step S8 to determine whether the color image adjustment control is performed during the previous image forming operation.

When the above-described color image adjustment control is performed in the monochrome mode, the controller 50 adjusts the positions of the black image and the color (yellow, cyan, and magenta) images before forming a full-color image, which is an overlaid or composite image of yellow, cyan, magenta, and black images. At this time, it is not necessary to form all color pattern images of yellow, cyan, and magenta images, which is generally performed when adjusting the positions of the black image and the color (yellow, cyan, and magenta) images. The positional deviation between the yellow, cyan, and magenta images has already been adjusted in the monochrome mode. Therefore, the control 50 checks the black image and one of the yellow, cyan, and magenta images. For example, the controller 50 determines the positional deviation between the magenta image and the black image, and adjusts the obtained amount of positional deviation of the magenta image with respect to the reference black image to the respective image forming conditions of the yellow, cyan, and magenta images. With the above-described operation, the full-color image can be adjusted in a shorter period of time and a smaller amount of toner than when forming four pattern images to adjust positional deviation of the images.

Therefore, when the controller 50 determines that the color image adjustment control is performed during the previous image forming operation, the result of step S8 is YES, and the process goes to step S9 followed by steps S10 and S11.

In step S9, the controller 50 forms the pattern images of magenta and black toners on the recording medium conveyance belt 8. Then in step S10, the positional deviation of the magenta (M) pattern images on the photoconductor 1 (the photoconductor 1M) is detected with reference to the black (B) pattern image, and based on the detection results, the image forming condition of magenta, cyan, and yellow images (e.g., such as a start timing of writing a latent image to each photoconductor 1) is adjusted. After completion of the positional adjustment of the respective color images, which are yellow image, cyan image, magenta image, and black image, the controller 50 starts the full-color image forming in step S11.

When the controller 50 determines that the color image adjustment control is not performed during the previous image forming operation, the result of step S8 is NO, and the controller 50 skips steps S9 and S10 and starts the full-color image forming in step S11.

Example Configuration 3

Figure 8:
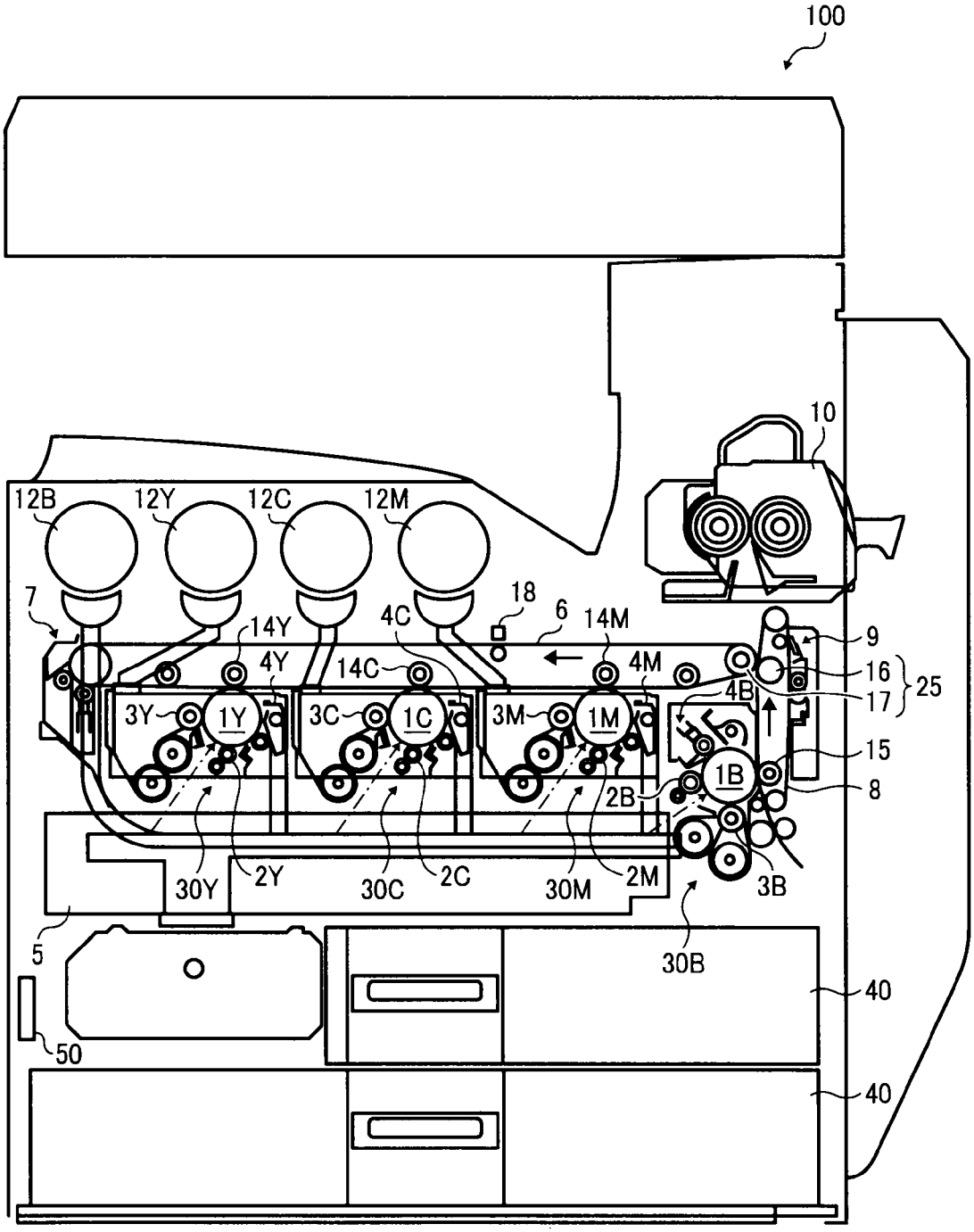
FIG. 8 is a schematic configuration of an image forming apparatus according to Example 3 of the image forming apparatus of FIG. 1.

FIG. 8 illustrates another example configuration of the image forming apparatus 100, which is hereinafter referred to as Example Configuration 3.

Different from Example Configurations 1 and 2, the image forming apparatus 100 according to Example Configuration 3 does not include the optical sensor 11 disposed facing the outer surface of the recording medium conveyance belt 8. As shown in Example Configuration 3 of FIG. 8, the image forming apparatus 100 includes an optical sensor 18 disposed facing the outer surface of the intermediate transfer belt 6 in a range of from the secondary image transfer nip portion to an arranging position of the intermediate transfer belt cleaning unit 7 in the direction of rotation of the intermediate transfer belt 6. The optical sensor 18 serves as a first image detector and a second image detector.

In Example Configuration 3, the secondary image transfer mechanism 25 transfers the black correction pattern images formed on the recording medium conveyance belt 8 from the recording medium conveyance belt 8 onto the intermediate transfer belt 6. At this time, a given voltage is applied to the secondary image transfer mechanism 25. The given voltage has a polarity opposite that of the voltage applied when a color image is transferred from the intermediate transfer belt 6 to the recording medium or the recording medium conveyance belt 8.

As described above, the optical sensor 18 in Example Configuration 3 is disposed facing the outer surface of the intermediate transfer belt 6 in a range of from the secondary image transfer nip portion to an arranging position of the intermediate transfer belt cleaning unit 7 in a direction of rotation of the intermediate transfer belt 6. With this configuration, as shown in FIG. 8, the optical sensor 18 can be disposed away from the fixing unit 10 that generates a high heat therefrom and therefore reduce the thermal load of the optical sensor 18. Further, the optical sensor 18 may be located away from an area where toner is scattered when the color image is transferred from the intermediate transfer belt 6 onto the recording medium for secondary image transfer and/or when the recording medium having an image thereon is conveyed, thereby reducing an amount of contamination accumulated around the optical sensor 18.

Further, if the secondary image transfer nip portion is disposed downstream from the direct transfer nip portion in a direction of conveyance of the recording medium, the optical sensor 18 disposed facing the outer surface of the intermediate transfer belt 6 can detect the yellow, cyan, magenta, and black pattern images by forming these color pattern images onto the recording medium conveyance belt 8, as shown in FIG. 2, and then onto the intermediate transfer belt 6, for example. In this case, the recording medium conveyance belt cleaning unit 9 is configured to move into and out of contact with the recording medium conveyance belt 8. At least when the color pattern images pass a position opposite the recording medium conveyance belt cleaning unit 9, the recording medium conveyance belt cleaning unit 9 is separated from the recording medium conveyance belt 8.

A different example is that the yellow, cyan, and magenta pattern images are formed on the intermediate transfer belt 6, the black pattern image is formed on the recording medium conveyance belt 8, and the black pattern image formed on the recording medium conveyance belt 8 is transferred onto the intermediate transfer belt 6 to form the yellow, cyan, magenta, and black pattern images on the intermediate transfer belt 6. Then, the optical sensor 18 can detect the yellow, cyan, magenta, and black pattern images on the intermediate transfer belt 6 formed on the intermediate transfer belt 6.

At this time, when the yellow, cyan, and magenta pattern images formed on the intermediate transfer belt 6 pass the secondary image transfer nip portion, the contact and separation mechanism 20 separates the intermediate transfer belt 6 from the recording medium conveyance belt 8 and rotates the intermediate transfer belt 6, so as not to transfer the yellow, cyan, and magenta pattern images formed on the intermediate transfer belt 6 onto the recording medium conveyance belt 8. After the yellow, cyan, and magenta pattern images formed on the intermediate transfer belt 6 have passed the secondary image transfer nip portion completely, the contact and separation mechanism 20 contacts the intermediate transfer belt 6 and the recording medium conveyance belt 8 so that the black pattern image can be transferred from the recording medium conveyance belt 6 onto the intermediate transfer belt 8.

Further, the intermediate transfer belt cleaning unit 7 and the recording medium conveyance belt cleaning unit 9 are configured to move into and out of contact with the intermediate transfer belt 6 and the recording medium conveyance belt 8, respectively. When at least the pattern image passes a position opposite the intermediate transfer belt cleaning unit 7 and the recording medium conveyance belt cleaning unit 9, the intermediate transfer belt cleaning unit 7 and the recording medium conveyance belt cleaning unit 9 are separated from the intermediate transfer belt 6 and the recording medium conveyance belt 8, respectively.

Example Configuration 4

Figure 9:
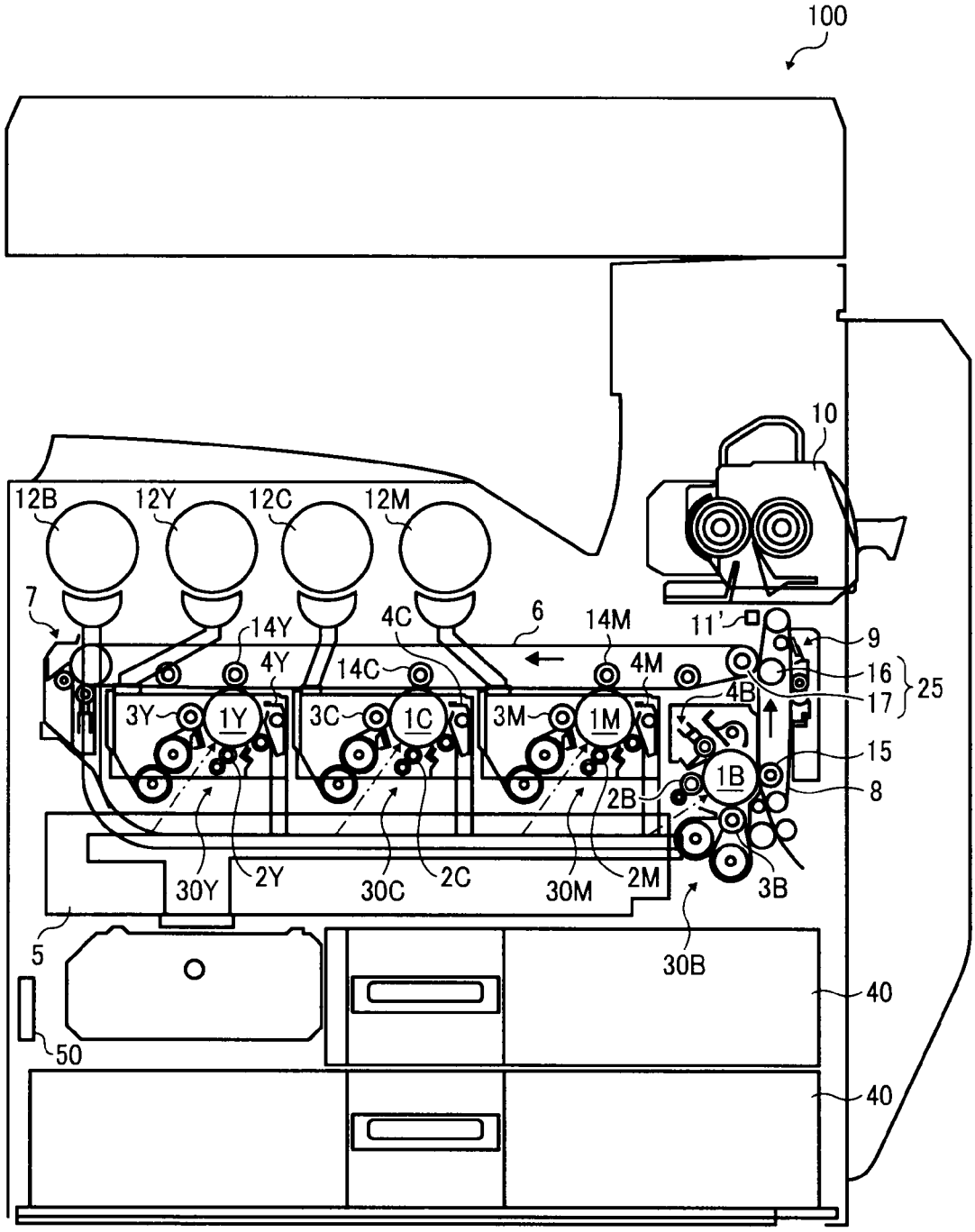
FIG. 9 is a schematic configuration of an image forming apparatus according to Example 4 of the image forming apparatus of FIG. 1.

FIG. 9 illustrates another example configuration of the image forming apparatus 100, which is hereinafter referred to as Example Configuration 4.

Different from Example Configuration 1 of FIG. 3, as shown in Example Configuration 4 of FIG. 9, an optical sensor 11' that serves as an image detector is disposed facing the outer surface of the recording medium conveyance belt 8 in a range of from a transfer end portion where the image transfer of the four-color toner image onto the recording medium ends or the secondary image transfer nip portion disposed downstream from the direct transfer nip portion in a direction of conveyance of the recording medium to the separation position where the recording medium is separated from the recording medium conveyance belt 8. By disposing the optical sensor 11' at the above-described position, the amount of toner adhesion to the recording medium and the passage of the recording medium can be detected separately from the above-described detection of the correction pattern images.

For example, when the optical sensor 11' detects the color pattern images transferred onto the recording medium conveyance belt 8, values output from the optical sensor 11' may vary. The output values also vary when the optical sensor 11' turns on as the recording medium passes the position opposite the optical sensor 11'.

When the recording medium is conveyed correctly, the output values repeatedly change at constant intervals. By contrast, if the fluctuation timing of the output values of the optical sensor 11' previously departs from a given reference range and the output values of the optical sensor 11 have not been changed even when the recording medium has passed the position opposite the optical sensor 11', it means that the recording medium has not reached the position opposite the optical sensor 11'. Based on the detection, a paper jam that has occurred at a portion upstream from the arranging position of the optical sensor 11' in a direction of movement of the recording medium conveyance belt 8 can be detected. Further, when the paper jam is detected, a message indicating that the paper jam has occurred is displayed on an operation panel mounted on the main body of the image forming apparatus 100. This operation can inform a user of the paper jam and stop the image forming operation.

When an image that has a given or greater size sufficiently detectable by the optical sensor 11' is formed on the recording medium, the optical sensor 11' can detect the amount of toner adhering to the recording medium. That is, the optical sensor 11' can detect and adjust the image density on the recording medium.

In a digital image forming apparatus such as the image forming apparatus 100 according to an exemplary embodiment of the present invention, before an image is written on the photoconductor 1, size, color, and density of an image to pass the opposite portion of the optical sensor 11' can be determined. For example, according to image data of a solid image, the controller 50 knows in advance that the solid image passes the position opposite the optical sensor 11'. Therefore, the optical sensor 11' is turned on to detect the image density of the solid image formed on the recording medium so as to determine whether the image density of the solid image is at or above the given image density level.

When the image density of a solid image formed on the detected recording medium is at a given constant image density level or below, the controller 50 corrects the development bias of the image forming unit 30 and the amount of optical light emitted by the optical writing unit 5 so that the image density can reach the given image density level. Alternatively, to cause the image density to reach the given image density level, the controller 50 corrects a bias applied to the direct transfer roller 15 to increase or decrease the amount of transfer electric current, thereby adjusting the transfer rate of black image from the photoconductor 1B onto the recording medium. Further, the amounts of adhesion of color toner (yellow, cyan, and magenta toners) to the recording medium are detected so as to correct the development biases of the image forming units 30Y, 30C, and 30M and/or the amount of optical light emitted by the optical writing unit 5. Alternatively, to cause the image density to reach the given image density level, the controller 50 corrects biases applied to the primary image transfer roller 14 and the secondary image transfer mechanism 25 to increase or decrease the amount of transfer electric current, thereby adjusting the transfer rates of color images or yellow, cyan, and magenta images to the recording medium.

Next, descriptions are given of toner used in the image forming apparatus 100 according to an exemplary embodiment of the present invention.

In order to correspond various recording media, in other words, to prevent poor transferability of the color image from the intermediate transfer belt 6 onto the recording medium by elastically deforming the surface of the intermediate transfer belt 6 followed by an uneven surface of the recording medium having convex and concave portions, it is preferable that the intermediate transfer belt 6 used in this exemplary embodiment of the present invention includes an elastic belt formed by an elastic material. Examples of the elastic materials for the intermediate transfer belt 6 include, but not limited to, urethane rubber, silicone rubber, acrylonitrilebutadiene rubber (NBR), ethylene-propylene rubber (EPM, EPDM), etc.

The toner of the present invention includes at least a binder resin and a colorant. The lubricant scraped from a molded lubricant, not shown, may be added to the surface of the toner to reduce friction. In addition, the toner of the present invention may optionally include a charge controlling agent for controlling charging ability of the toner, a release agent for increasing a releasing ability of the toner with respect to the fixing unit 10, and an external additive for enhancing fluidity of the toner.

(Binder Resin)

Suitable binder resins for use in the toner of the present invention include ester resins, vinyl resins, amide resins, epoxy resins, silicone resins, etc. These resins can be used alone or in combination. Of these resins, preferably vinyl resins are used.

Specific examples of the binder resins include styrene polymers and substituted styrene polymers such as polystyrene, poly-p-chlorostyrene and polyvinyltoluene; and styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-acrylonitrile copolymers, styrene-vinyl methyl ether copolymers, styrene-butadiene copolymers, styrene-methyl methacrylate-butyl acrylate copolymers, etc.

(Colorant)

Suitable colorants for use in the toner of the present invention include known dyes and pigments. Specific examples of the colorants include carbon black, Nigrosine dyes, black iron oxide, Naphthol Yellow S, Hansa Yellow (10G, 5G and G), Cadmium Yellow, yellow iron oxide, loess, chrome yellow, Titan Yellow, polyazo yellow, red iron oxide, red lead, orange lead, cadmium red, cadmium mercury red, antimony orange, Permanent Red 4R, Para Red, Fire Red, p-chloro-o-nitroaniline red, LitholFast Scarlet G, Brilliant Fast Scarlet, Brilliant Carmine BS, Permanent Red (F2R, F4R, FRL, FRLL and F4RH), Fast Scarlet VD, Vulcan Fast Rubine B, Brilliant Scarlet G, Lithol Rubine GX, Permanent Red F5R, Brilliant Carmine 6B, Pigment Scarlet 3B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, Pigment Green B, Naphthol Green B, Green Gold, titanium oxide, zinc oxide, lithopone and the like. These materials are used alone or in combination.

A content of the colorant in the toner is preferably from 1% to 15% by weight, and more preferably from 3% to 10% by weight, based on total weight of the toner.

(Charge Controlling Agent)

Suitable charge controlling agents for use in the toner of the present invention include compounds including salicylic acid, Nigrosine dyes, compounds including quaternary ammonium salts, compounds including alkylpyridinium, etc. The contained amount of such charge controlling agent with respect to the toner is generally in a range of from 0.1% to 5%, preferably in a range of from 1% to 3%.

(Release Agent)

Suitable release agents for use in the toner of the present invention include polyolefin waxes such as low-molecular-weight polyethylene, low-molecular-weight polypropylene, copolymers of low-molecular-weight polyethylene and low-molecular-weight polypropylene, etc.; ester waxes such as lower alcohol fatty acid ester, higher alcohol fatty acid ester, polyol fatty acid ester, etc.; amide wax, and etc. The contained amount of such release agent with respect to the toner is generally in a range of from 0.5% to 10%, preferably in a range of from 1% to 5%.

Preferably, the toner particle has an average circularity of from approximately 0.92 to approximately 1.00.

The circularity is defined by the following equation 1:

Circularity *SR* of a particle=(circumference of circle identical in area with the projected grain image of the particle/circumference of the projected grain image) Equation 1.

As the shape of a toner particle is close to a truly spherical shape, the value of circularity becomes close to 1.00. The toner having a high circularity is easily influenced by a line of electric force when the toner is present on a carrier or a developing sleeve used for an electrostatic developing method, and an electrostatic latent image formed on the surface of the photoconductor 1 is faithfully developed by the toner along the line of electric force thereof.

When such toner is used in a known image forming apparatus, even if the cleaning blade or other cleaning member contacts or is abut against the photoconductor 1, the toner cannot be sufficiently removed. The insufficient removal of the toner may occur because the toner having a substantially spherical shape easily moves on the surface of the photoconductor 1.

To prevent the occurrence of the above-described condition, a force greater than a given force of the cleaning blade or other cleaning member when contacting the surface of the photoconductor 1 is applied to a cleaning member so that the cleaning member with the greater force can abut against the photoconductor 1 to effectively scrape the residual toner on the surface of the photoconductor 1. The greater force, however, may adversely affect the rotation speed or accuracy of travel of the photoconductor 1, resulting in a banding.

By contrast, in an exemplary embodiment of the present invention, both a lubricating unit and the toner may apply lubricant onto the surface of the photoconductor 2 to reduce the coefficient of friction on the surface of the photoconductor 1. With the above-described action, the transferability of toner during the transfer operation may be enhanced, that is, a greater amount of toner can be transferred onto a recording medium or an intermediate transfer member. The above-described increase of transfer amount of toner can reduce the residual toner on the surface of the photoconductor 1 and the load of the cleaning blade. At the same time, the residual toner can be reduced from the surface of the photoconductor 1 without causing a banding when the cleaning blade abuts against the surface of the photoconductor 1 with the greater force.

A circularity of a dry toner manufactured by a dry pulverization method is thermally or mechanically controlled to be within the above-described range. For example, a thermal method in which dry toner particles are sprayed with an atomizer together with hot air can be used for preparing a toner having a spherical form. That is a thermal process of ensphering the toner particle. Alternatively, a mechanical method in which a spherical toner can be prepared by agitating, dry toner particles in a mixer such as a ball mill, with a medium such as a glass having a low specific gravity can be used. However, aggregated toner particles having a large particle diameter are formed by the thermal method or fine powders are produced by the mechanical method. Therefore, it is necessary to subject the residual toner particles to a classifying treatment. If a toner is produced in an aqueous medium, the shape of the toner can be controlled by controlling the degree of agitation in the solvent removing step.

Further, a fluidizing agent can be added to the toner.

Examples of the fluidizing agent are fine particles of metallic oxide such as silica, titania, alumina, magnesia, zirconia, ferrite, magnetite, etc., and fine particles of metallic oxide processed by silane coupling agent, titanate coupling agent, or zircon-aluminate. It is preferable to use silica or titania that is hydrophobized by the above-described coupling agents. Silica including a primary particle with a small diameter thereof can contribute to an increase of fluidity of toner. Titania can control a charge amount of toner. It is more preferable to use silica and titania in combination.

Further, an amount of lubricant added to the surface of a toner particle is preferably in a range of from approximately 0.1% to approximately 2.0%.

The amount of lubricant below 0.1% is insufficient to supply to the surface of the photoconductor 1, and it is difficult to reduce the coefficient of friction of the photoconductor 1.

In addition, the amount of lubricant above 2.0% can cause the toner held on the photoconductor 1 to adhere to the charge roller, resulting in a production of defect images.

In general, the smaller volume-based average particle diameter Dv the toner has, the better thin line reproducibility the toner has. Therefore, it is preferable the toner has the volume-based average particle diameter Dv of less than 8 μm. However, the smaller volume-based average particle diameter the toner has, the worse developing and cleaning properties the toner has. Therefore, it is preferable the toner has the volume-based average particle diameter Dv of greater than 3 μm.

When the toner has the volume-based average particle diameter Dv of less than 3 μm, a greater amount of very fine toner particles, which are difficult to be developed, are held on the respective surface of the carriers or on the surface of the developing roller. Therefore, the toner other than toner including the very fine toner particles cannot sufficiently contact or rub the carrier or the developing roller. The above-described insufficient contact can increase an amount of the reversely charged toner, resulting in a production of defect image such as an image having fogging on the background area. Accordingly, it is preferable that the toner has the volume-based average particle diameter Dv of greater than 3 μm.

Particle diameter distribution of toner indicated based on a ratio of the volume-based average particle diameter Dv to a number-based average particle diameter Dn is preferable to be in a range from approximately 1.05 to approximately 1.40. A sharp control of the distribution of the toner particle diameters, the distribution of the toner charge can be uniform. When the ratio Dv/Dn is greater than 1.40, the amount of the irregular charge toner becomes large and it becomes hard to produce an image having high resolution and high quality. A toner particle having the ratio Dv/Dn less than 1.05 is difficult to produce and is impractical to use. The above-described particle diameter of toner can be measured by, for example, a Coultar counter method using a measuring instrument for measuring particle diameter distribution of toner, such as, Coultar counter multisizer (manufactured by Coulter Electronics Limited). By using the above-described measuring instrument, the particle diameter of toner may be obtained with a 50 μm aperture, by measuring the average of particle diameters of 50,000 toner particles.

It is preferable that a shape factor "SF-1" of the toner used in each of the developing units 3Y, 3C, 3M, and 3K is in a range of from approximately 100 to approximately 180, and the shape factor "SF-2" of the toner used in each of the developing units 4Y, 4C, 4M, and 4K is in a range of from approximately 100 to approximately 180.

Figure 10A:
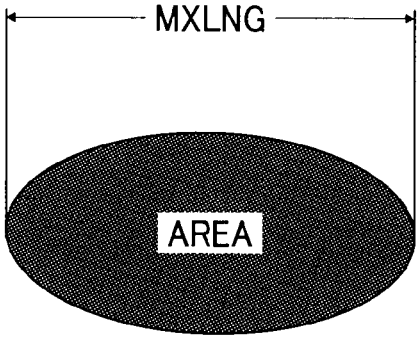
FIG. 10A is a schematic drawing of a toner having an "SF-1" shape factor.

Referring to FIG. 10A, the shape factor "SF-1" is a parameter representing the roundness of a particle.

The shape factor "SF-1" of a particle is calculated by a following Equation 1:

$$SF-1=\{(MXLNG)^2/AREA\}\times(100\pi/4) \quad \text{Equation 1,}$$

where "MXLNG" represents the maximum major axis of an elliptical-shaped figure obtained by projecting a toner particle on a two dimensional plane, and "AREA" represents the projected area of elliptical-shaped figure.

When the value of the shape factor "SF-1" is 100, the particle has a perfect spherical shape. As the value of the "SF-1" increases, the shape of the particle becomes more elliptical.

Figure 10B:
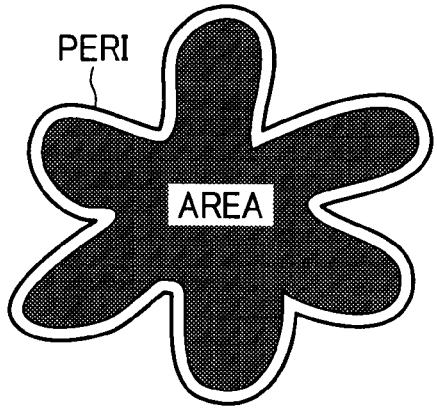
FIG. 10B is a schematic drawing of a toner having an "SF-2" shape factor.

Referring to FIG. 10B, the shape factor "SF-2" is a value representing irregularity (i.e., a ratio of convex and concave portions) of the shape of the toner. The shape factor "SF-2" of a particle is calculated by a following Equation 2:

$$SF-2=\{(PERI)^2/AREA\}\times(100\pi/4) \quad \text{Equation 2,}$$

where "PERI" represents the perimeter of a figure obtained by projecting a toner particle on a two dimensional plane.

When the value of the shape factor "SF-2" is 100, the surface of the toner is even (i.e., no convex and concave portions). As the value of the "SF-2" increases, the surface of the toner becomes uneven (i.e., the number of convex and concave portions increase).

In this embodiment, toner images are sampled by using a field emission type scanning electron microscope (FE-SEM) S-800 manufactured by HITACHI, LTD. The toner image information is analyzed by using an image analyzer (LUSEX3) manufactured by NIREKO, LTD.

As the toner shape becomes spherical, a toner particle becomes held in point-contact with another toner particle or the photoconductor 1. Under the above-described condition, the toner adhesion force between two toner particles may decrease, resulting in the increase in toner fluidity, and the toner adhesion force between the toner particle and the photoconductor 1 may decrease, resulting in the increase in toner transferability. And, the toner storing unit may easily collect reversely charge toner.

Further, considering collecting performance, it is preferable that the values of the shape factors "SF-1" and "SF-2" are 100 or greater. As the values of the shape factors "SF-1" and "SF-2" become greater, the toner charge distribution becomes greater and a load to the toner storing unit becomes greater. Therefore, the values of the shape factors "SF-1" and "SF-2" are preferable to be less than 180.

Further, the toner used in the image forming apparatus 100 may be substantially spherical.

Figure 11A:
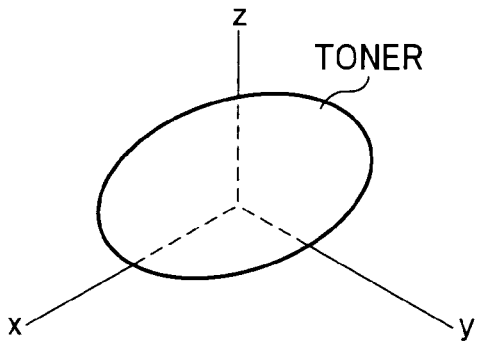
FIG. 11A is an outer shape of a toner used in the image forming apparatuses according to an exemplary embodiment of the present invention.
Figure 11B:
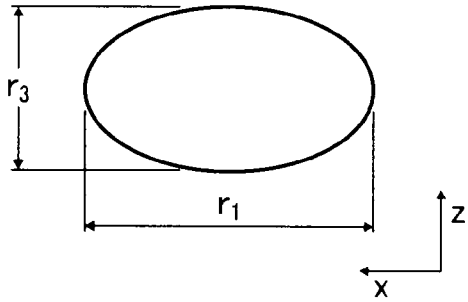
FIG. 11B is a schematic cross-sectional view of the toner, showing major and minor axes and a thickness of FIG. 11A; and is
Figure 11C:
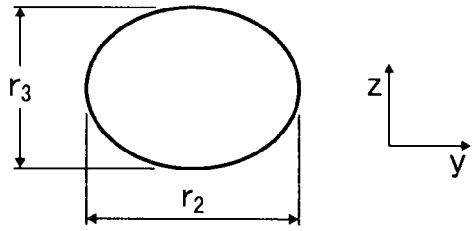
FIG. 11C is a schematic cross-sectional view of the toner, showing major and minor axes and a thickness of FIG. 11A.

Referring to FIGS. 11A, 11B, and 11C, sized of the toner is described. An axis "x" of FIG. 11A represents a major axis "r1" of FIG. 11B, which is the longest axis of the toner. An axis "y" of FIG. 11A represents a minor axis "r2" of FIG. 11B, which is the second longest axis of the toner. The axis "z" of FIG. 11A represents a thickness "r3" of FIG. 11B, which is a thickness of the shortest axis of the toner. The toner has a relationship between the major and minor axes "r1" and "r2" and the thickness "r3" as follows:

$$r1>r2>r3.$$

The toner of FIG. 11A is preferably in a spindle shape in which the ratio (r2/r1) of the major axis "r1" to the minor axis "r2" is approximately 0.5 to approximately 1.0, and the ratio (r3/r2) of the thickness "r3" to the minor axis "r2" is approximately 0.7 to approximately 1.0.

When the ratio (r2/r1) is less than approximately 0.5, the toner has an irregular particle shape, and the value of the toner charge distribution increases.

When the ratio (r3/r2) is less than approximately 0.7, the toner has an irregular particle shape, and the value of the toner charge distribution increases. When the ratio (r3/r2) is approximately 1.0, the toner has a substantially round shape, and the value of the toner charge distribution decreases.

The lengths showing with "r1", "r2" and "r3" can be monitored and measured with scanning electron microscope (SEM) by taking pictures from different angles.

The shape of toner depends on the manufacturing method used. For example, a toner particle produced by a dry type grinding method has an irregular shape with an uneven surface. The irregular-shaped toner, however, can be modified to an approximately round toner by being subjected to a mechanical treatment or a thermal treatment. Toner produced by a method such as a suspension polymerization method and an emulsion polymerization method may have a smooth surface and a perfectly spherical form. In this regard, spherical form can be charged to elliptic form by performing agitating in a middle of reaction, i.e., applying a shearing force to the toner.

A toner having a substantially spherical shape is preferably prepared by a method in which a toner composition including a polyester prepolymer having a function group including a nitrogen atom, a polyester, a colorant, and a releasing agent is subjected to an elongation reaction and/or a crosslinking reaction in an aqueous medium in the presence of fine resin particles. Since thus prepared toner has a hardened surface, the toner has a good hot offset resistance. Therefore, toner hardly causes a problem in that toner particles adhere to the fixing unit 10, which would resulting in degradation in the resultant copy image.

Toner constituents and preferable manufacturing method of the toner of the prevent invention will be described below.

(Polyester)

Polyester is produced by the condensation polymerization reaction of a polyhydric alcohol compound with a polyhydric carboxylic acid compound.

As the polyhydric alcohol compound (PO), dihydric alcohol (DIO) and polyhydric alcohol (TO) higher than trihydric alcohol can be used. In particular, a dihydric alcohol DIO alone or a mixture of a dihydric alcohol DIO with a small amount of polyhydric alcohol (TO) is preferably used. Specific examples of the dihydric alcohol (DIO) include alkylene glycol such as ethylene glycol, 1,2-propylene glycol, 1,3-propylene glycol, 1,4-butanediol, 1,6-hexanediol; alkylene ether glycol such as diethylene glycol, triethylene glycol, dipropylene glycol, polyethylene glycol, polypropylene glycol, polytetramethylene ether glycol; alicyclic diol such as 1,4-cyclohexane dimethanol, hydrogenated bisphenol A; bisphenols such as bisphenol A, bisphenol F, bisphenol S; adducts of the above-mentioned alicyclic diol with an alkylene oxide such as ethylene oxide, propylene oxide, butylenes oxide; adducts of the above-mentioned bisphenol with an alkylene oxide such as ethylene oxide, propylene oxide, butylenes oxide. In particular, alkylene glycol having 2 to 12 carbon atoms and adducts of bisphenol with an alkylene oxide are preferably used, and a mixture thereof is more preferably used. Specific examples of the polyhydric alcohol (TO) higher than trihydric alcohol include multivalent aliphatic alcohol having tri-octa hydric or higher hydric alcohol such as glycerin, trimethylolethane, trimethylolpropane, pentaerythritol and sorbitol; phenol having tri-octa hydric or higher hydric alcohol such as trisphenol PA, phenolnovolak, cresolnovolak; and adducts of the above-mentioned polyphenol having tri-octa hydric or higher hydric alcohol with an alkylene oxide.

As the polycarboxylic acid (PC), dicarboxylic acid (DIC) and polycarboxylic acids having 3 or more valences (TC) can be used. A dicarboylic acid (DIC) alone, or a mixture of the dicarboxylic acid (DIC) and a small amount of polycarboxylic acid having 3 or more valences (TC) is preferably used. Specific examples of the dicarboxylic acids (DIC) include alkylene dicarboxylic acids such as succinic acid, adipic acid and sebacic acid; alkenylene dicarboxylic acid such as maleic acid and fumaric acid; and aromatic dicarboxylic acids such as phthalic acid, isophthalic acid, terephthalic acid and naphthalene dicarboxylic acid. In particular, alkenylene dicarboxylic acid having 4 to 20 carbon atoms and aromatic dicarboxylic acid having 8 to 20 carbon atoms are preferably used. Specific examples of the polycarboxylic acid having 3 or more valences (TC) include aromatic polycarboxylic acids having 9 to 20 carbon atoms such as trimellitic acid and pyromellitic acid. The polycarboxylic acid (PC) can be formed from a reaction between the above-mentioned acids anhydride or lower alkyl ester such as methyl ester, ethyl ester and isopropyl ester.

The polyhydric alcohol (PO) and the polycarboxylic acid (PC) are mixed such that the equivalent ratio ([OH]/[COOH]) between the hydroxyl group [OH] of the poly hydric alcohol (PO) and the carboxylic group [COOH] of the polycarboxylic acid (PC) is typically from 2/1 to 1/1, preferably from 1.5/1 to 1/1 and more preferably from 1.3/1 to 1.02/1.

In the condensation polymerization reaction of a polyhydric alcohol (PO) with a polyhydric carboxylic acid (PC), the polyhydric alcohol (PO) and the polyhydric carboxylic acid (PC) are heated to a temperature from approximately 150° C. to approximately 280° C. in the presence of a known esterification catalyst, e.g., tetrabutoxy titanate or dibutyltineoxide. The generated water is distilled off with pressure being lowered, if necessary, to obtain a polyester resin containing a hydroxyl group. The hydroxyl value of the polyester resin is preferably 5 or more while the acid value of polyester is usually between 1 and 30, and preferably between 5 and 20. When a polyester resin having such an acid value is used, the residual toner is easily negatively charged. In addition, the affinity of the toner for recording paper can be improved, resulting in improvement of low temperature fixability of the toner. However, a polyester resin with an acid value above 30 can adversely affect stable charging of the residual toner, particularly when the environmental conditions vary.

The weight-average molecular weight of the polyester resin is from 10,000 to 400,000, and more preferably from 20,000 to 200,000. A polyester resin with a weight-average molecular weight between 10,000 lowers the offset resistance of the residual toner while a polyester resin with a weight-average molecular weight above 400,000 lowers the temperature fixability.

A urea-modified polyester is preferably included in the toner in addition to unmodified polyester produced by the above-described condensation polymerization reaction. The urea-modified polyester is produced by reacting the carboxylic group or hydroxyl group at the terminal of a polyester obtained by the above-described condensation polymerization reaction with a polyisocyanate compound (PIC) to obtain polyester prepolymer (A) having an isocyanate group, and then reacting the prepolymer (A) with amines to crosslink and/or extend the molecular chain.

Specific examples of the polyisocyanate compound (PIC) include aliphatic polyvalent isocyanate such as tetra methylenediisocyanate, hexamethylenediisocyanate, 2,6-diisocyanate methyl caproate; alicyclic polyisocyanate such as isophoronediisocyanate, cyclohexylmethane diisocyanate; aromatic diisocyanate such as tolylenediisocyanate, diphenylmethene diisocyanate; aroma-aliphatic diisocyanate such as α,α,α',α',-tetramethylxylene diisocynate; isocaynates; the above-mentioned isocyanats blocked with phenol derivatives, oxime, caprolactam; and a combination of two or more of them.

The polyisocyanate compound (PIC) is mixed such that the equivalent ratio ([NCO]/[OH]) between an isocyanate group [NCO] and a hydroxyl group [OH] of polyester having the isocyanate group and the hydroxyl group is typically from 5/1 to 1/1, preferably from 4/1 to 1.2/1, and more preferably from 2.5/1 to 1.5/1. A ratio of [NCO]/[OH] higher than 5 can deteriorate low-temperature fixability. As for a molar ratio of [NCO] below 1, if the urea-modified polyester is used, then the urea content in the ester is low, lowering the hot offset resistance.

The content of the constitutional unit obtained from a polyisocyanate (PIC) in the polyester prepolymer (A) is from 0.5% to 40% by weight, preferably from 1% to 30% by weight and more preferably from 2% to 20% by weight. When the content is less than 0.5% by weight, hot offset resistance of the resultant toner deteriorates and in addition the heat resistance and low temperature fixability of the toner also deteriorate. In contrast, when the content is greater than 40% by weight, low temperature fixability of the resultant toner deteriorates.

The number of the isocyanate groups included in a molecule of the polyester prepolymer (A) is at least 1, preferably from 1.5 to 3 on average, and more preferably from 1.8 to 2.5 on average. When the number of the isocyanate group is less than 1 per 1 molecule, the molecular weight of the urea-modified polyester decreases and hot offset resistance of the resultant toner deteriorates.

Specific examples of the amines (B) include diamines (B1), polyamines (B2) having three or more amino groups, amino alcohols (B3), amino mercaptans (B4), amino acids (B5) and blocked amines (B6) in which the amines (B1-B5) mentioned above are blocked.

Specific examples of the diamines (B1) include aromatic diamines (e.g., phenylene diamine, diethyltoluene diamine and 4,4'-diaminodiphenyl methane); alicyclic diamines (e.g., 4,4'-diamino-3,3'-dimethyldicyclohexyl methane, diamino cyclohexane and isophoron diamine); aliphatic diamines (e.g., ethylene diamine, tetramethylene diamine and hexamethylene diamine); etc. Specific examples of the polyamines (B2) having three or more amino groups include diethylene triamine, triethylene tetramine. Specific examples of the amino alcohols (B3) include ethanol amine and hydroxyethyl aniline. Specific examples of the amino mercaptan (B4) include aminoethyl mercaptan and aminopropyl mercaptan. Specific examples of the amino acids (B5) include amino propionic acid and amino caproic acid. Specific examples of the blocked amines (B6) include ketimine compounds which are prepared by reacting one of the amines B1-B5 mentioned above with a ketone such as acetone, methyl ethyl ketone and methyl isobutyl ketone; oxazoline compounds, etc. Among these compounds, diamines (B1) and mixtures in which a diamine is mixed with a small amount of a polyamine (B2) are preferably used.

The mixing ratio (i.e., a ratio [NCO]/[NHx]) of the content of the prepolymer (A) having an isocyanate group to the amine (B) is from 1/2 to 2/1, preferably from 1.5/1 to 1/1.5 and more preferably from 1.2/1 to 1/1.2. When the mixing ratio is greater than 2 or less than 1/2, molecular weight of the urea-modified polyester decreases, resulting in deterioration of hot offset resistance of the resultant toner.

Suitable polyester resins for use in the toner of the present invention may include a urea-modified polyesters. The urea-modified polyester may include a urethane bonding as well as a urea bonding. The molar ratio (urea/urethane) of the urea bonding to the urethane bonding is from 100/0 to 10/90, preferably from 80/20 to 20/80, and more preferably from 60/40 to 30/70. When the molar ratio of the urea bonding is less than 10%, hot offset resistance of the resultant toner deteriorates.

The urea modified polyester is produced by, for example, a one-shot method. Specifically, a polyhydric alcohol (PO) and a polyhydric carboxylic acid (PC) are heated to a temperature of approximately 150 degrees Celsius to approximately 280 degrees Celsius in the presence of the known esterification catalyst, e.g., tetrabutoxy titanate or dibutyltineoxide to be reacted. The resulting water is distilled off with pressure being lowered, if necessary, to obtain a polyester containing a hydroxyl group. Then, a polyisocyanate (PIC) is reacted with the polyester obtained above a temperature of from approximately 40 degrees Celsius to approximately 140 degrees Celsius to prepare a polyester prepolymer (A) having an isocyanate group. The prepolymer (A) is further reacted with an amine (B) at a temperature of from 0 degree Celsius to approximately 140 degrees Celsius to obtain a urea-modified polyester.

At the time of reacting the polyisocyanate (PIC) with a polyester and reacting the polyester prepolymer (A) with the amines (B), a solvent may be used, if necessary. Specific examples of the solvent include solvents inactive to the isocyanate (PIC), e.g., aromatic solvents such as toluene, xylene; ketones such as acetone, methyl ethyl ketone, methyl isobutyl ketone; esters such as ethyl acetate; amides such as dimethyl formamide, dimethyl acetatamide; and ethers such as tetrahydrofuran.

If necessary, a reaction terminator may be used for the crosslinking reaction and/or extension reaction of a polyester prepolymer (A) with an amine (B), to control the molecular weight of the resultant urea-modified polyester. Specific examples of the reaction terminators include a monoamine such as diethylamine, dibutylamine, butylamine, lauryl amine, and blocked substances thereof such as a ketimine compound.

The weight-average molecular weight of the urea-modified polyester is not less than 10,000, preferably from 20,000 to 10,000,000 and more preferably from 30,000 to 1,000,000. A molecular weight of less than 10,000 deteriorates the hot offset resisting property. The number-average molecular weight of the urea-modified polyester is not particularly limited when the after-mentioned unmodified polyester resin is used in combination. Namely, the weight-average molecular weight of the urea-modified polyester resins has priority over the number-average molecular weight thereof. However, when the urea-modified polyester is used alone, the number-average molecular weight is from 2,000 to 15,000, preferably from 2,000 to 10,000, and more preferably from 2,000 to 8,000. When the number-average molecular weight is greater than 20,000, the low temperature fixability of the resultant toner deteriorates, and in addition the glossiness of full color images deteriorates.

In the present invention, not only the urea-modified polyester alone but also the unmodified polyester resin can be included with the urea-modified polyester. A combination thereof improves low temperature fixability of the resultant toner and glossiness of color images produced by the image forming apparatus 100, and using the combination is more preferable than using the urea-modified polyester alone. It is noted that the unmodified polyester may contain polyester modified by a chemical bond other than the urea bond.

It is preferable that the urea-modified polyester at least partially mixes with the unmodified polyester resin to improve the low temperature fixability and hot offset resistance of the resultant toner. Therefore, the urea-modified polyester preferably has a structure similar to that of the unmodified polyester resin.

A mixing ratio between the urea-modified polyester and polyester resin is from 20/80 to 95/5 by weight, preferably from 70/30 to 95/5 by weight, more preferably from 75/25 to 95/5 by weight, and even more preferably from 80/20 to 93/7 by weight. When the weight ratio of the urea-modified polyester is less than 5%, the hot offset resistance deteriorates, and in addition, it is difficult to impart a good combination of high temperature preservability and low temperature fixability of the toner.

The toner binder preferably has a glass transition temperature (Tg) of from 45 degrees Celsius to 65 degrees Celsius, and preferably from 45 degrees Celsius to 60 degrees Celsius. When the glass transition temperature is less than 45 degrees Celsius., the high temperature preservability of the toner deteriorates. When the glass transition temperature is higher than 65 degrees Celsius., the low temperature fixability deteriorates.

Since the urea-modified polyester can exist on the surfaces of the mother toner particles, the toner of the present invention has better high temperature preservability than conventional toners including a polyester resin as a binder resin even though the glass transition temperature is low.

Here, the colorant, charge controlling agent, release agent, external additive, and the like can be prepared by using conventional materials.

The method for manufacturing the toner is described.

The toner of the present invention is produced by the following method, but the manufacturing method is not limited thereto.

(Preparation of Toner)

First, a colorant, unmodified polyester, polyester prepolymer having isocyanate groups and a parting agent are dispersed into an organic solvent to prepare a toner material liquid.

The organic solvent should preferably be volatile and have a boiling point of 100° C. or below because such a solvent is easy to remove after the formation of the toner mother particles. More specific examples of the organic solvent includes one or more of toluene, xylene, benzene, carbon tetrachloride, methylene chloride, 1,2-dichloroethane, 1,1,2-trichloroethane, trichloro ethylene, chloroform, monochlorobenzene, dichloroethylidene, methyl acetate, ethyl acetate, methyl ethyl ketone, methyl isobutyl ketone, and so forth. Particularly, the aromatic solvent such as toluene and xylene; and a hydrocarbon halide such as methylene chloride, 1,2-dichloroethane, chloroform or carbon tetrachloride is preferably used. The amount of the organic solvent to be used should preferably 0 parts by weight to 300 parts by weight for 100 parts by weight of polyester prepolymer, more preferably 0 parts by weight to 100 parts by weight for 100 parts by weight of polyester prepolymer, and even more preferably 25 parts by weight to 70 parts by weight for 100 parts by weight of polyester prepolymer.

The toner material liquid is emulsified in an aqueous medium in the presence of a surfactant and organic fine particles.

The aqueous medium for use in the present invention is water alone or a mixture of water with a solvent which can be mixed with water. Specific examples of such a solvent include alcohols (e.g., methanol, isopropyl alcohol and ethylene glycol), dimethylformamide, tetrahydrofuran, cellosolves (e.g., methyl cellosolve), lower ketones (e.g., acetone and methyl ethyl ketone), etc.

The content of the aqueous medium is typically from 50 to 2,000 parts by weight, and preferably from 100 to 1,000 parts by weight, per 100 parts by weight of the toner constituents. When the content is less than 50 parts by weight, the dispersion of the toner constituents in the aqueous medium is not satisfactory, and thereby the resultant mother toner particles do not have a desired particle diameter. In contrast, when the content is greater than 2,000, the manufacturing costs increase.

Various dispersants are used to emulsify and disperse an oil phase in an aqueous liquid including water in which the toner constituents are dispersed. Specific examples of such dispersants include surfactants, resin fine-particle dispersants, etc.

Specific examples of the dispersants include anionic surfactants such as alkylbenzenesulfonic acid salts, α-olefin sulfonic acid salts, and phosphoric acid salts; cationic surfactants such as amine salts (e.g., alkyl amine salts, aminoalcohol fatty acid derivatives, polyamine fatty acid derivatives and imidazoline), and quaternary ammonium salts (e.g., alkyltrimethylammonium salts, dialkyldimethylammonium salts, alkyldimethyl benzyl ammonium salts, pyridinium salts, alkyl isoquinolinium salts and benzethonium chloride); nonionic surfactants such as fatty acid amide derivatives, polyhydric alcohol derivatives; and ampholytic surfactants such as alanine, dodecyldi(aminoethyl)glycine, di(octylaminoethyle)glycine, and N-alkyl-N, N-dimethylammonium betaine.

A surfactant having a fluoroalkyl group can prepare a dispersion having good dispersibility even when a small amount of the surfactant is used. Specific examples of anionic surfactants having a fluoroalkyl group include fluoroalkyl carboxylic acids having from 2 to 10 carbon atoms and their metal salts, disodium perfluorooctanesulfonylgl-utamate, sodium 3-{omega-fluoroalkyl(C6-C11)oxy}-1-alkyl(C3-C4) sulfonate, sodium, 3-{omega-fluoroalkanoyl(C6-C8)-N-ethylamino}-1-propanesulfonate, fluoroalkyl(C11-C20) carboxylic acids and their metal salts, perfluoroalkylcarboxylic acids (7C-13C) and their metal salts, perfluoroalkyl(C4-C12) sulfonate and their metal salts, perfluorooctanesulfonic acid diethanol amides, N-propyl-N-(2-hydroxyethyl-)perfluorooctanesulfone amide, perfluoroalkyl(C6-C10)sulfoneamidepropyltrimethylammonium salts, salts of perfluoroalkyl (C6-C10)-N-ethylsulfonylglycin, monoperfluoroalkyl(C6-C16)e-thylphosphates, etc.

Specific examples of the marketed products of such surfactants having a fluoroalkyl group include SARFRON (Registered) S-111, S-112 and S-113, which are manufactured by ASAHI GLASS CO., LTD.; FLUORAD (Registered) FC-93, FC-95, FC-98 and FC-129, which are manufactured by SUMITOMO 3M LTD.; UNIDYNE (Registered) DS-101 and DS-102, which are manufactured by DAIKIN INDUSTRIES, LTD.; MEGAFACE (Registered) F-110, F-120, F-113, F-191, F-812 and F-833 which are manufactured by DAINIPPON INK AND CHEMICALS, INC.; ECTOP EF-102, 103, 104, 105, 112, 123A, 123B, 306A, 501, 201 and 204, which are manufactured by TOHCHEM PRODUCTS CO., LTD.; FUTARGENT (Registered) F-100 and F150 manufactured by NEOS; etc.

Specific examples of the cationic surfactants, which can disperse an oil phase including toner constituents in water, include primary, secondary and tertiary aliphatic amines having a fluoroalkyl group, aliphatic quaternary ammonium salts such as perfluoroalkyl(C6-C10)sulfone-amidepropyltrimethylammonium salts, benzalkonium salts, benzetonium chloride, pyridinium salts, imidazolinium salts, etc. Specific examples of the marketed products thereof include SARFRON (Registered) S-121 (manufactured by ASAHI GLASS CO., LTD.); FLUORAD (Registered) FC-135 (manufactured by SUMITOMO 3M LTD.); UNIDYNE DS-202 (manufactured by DAIKIN INDUSTRIES, LTD.); MEGAFACE (Registered) F-150 and F-824 (manufactured by DAINIPPON INK AND CHEMICALS, INC.); ECTOP EF-132 (manufactured by TOHCHEM PRODUCTS CO., LTD.); FUTARGENT (Registered) F-300 (manufactured by NEOS); etc.

Resin fine particles are added to stabilize toner source particles formed in aqueous solvent. The resin fine particles are preferably added such that the coverage ratio thereof on the surface of a toner source particle can be within 10% through 90%. For example, such resin fine particles may be methyl polymethacrylate particles of 1 μm and 3 μm, polystyrene particles of 0.5 μm and 2 μm, poly(styrene-acrylonitrile) particles of 1 μm, commercially, PB-200 (manufactured by KAO Co.), SGP, SGP-3G (manufactured by SOKEN), technopolymer SB (manufactured by SEKISUI PLASTICS CO., LTD.), micropearl (manufactured by SEKISUI CHEMICAL CO., LTD.) or the like.

Also, an inorganic dispersant such as calcium triphosphate, calcium carbonate, titanium oxide, colloidal silica, and hydroxyapatite may be used.

Further, it is possible to stably disperse toner constituents in water using a polymeric protection colloid in combination with the inorganic dispersants and/or particulate polymers mentioned above.

Specific examples of such protection colloids include polymers and copolymers prepared using monomers such as acids (e.g., acrylic acid, methacrylic acid, α-cyanoacrylic acid, α-cyanomethacrylic acid, itaconic acid, crotonic acid, fumaric acid, maleic acid and maleic anhydride), acrylic monomers having a hydroxyl group (e.g., β-hydroxyethyl acrylate, β-hydroxyethyl methacrylate, β-hydroxypropyl acrylate, (β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycolmonoacrylic acid esters, diethyleneglycolmonomethacrylic acid esters, glycerinmonoacrylic acid esters, N-methylolacrylamide and N-methylolmethacrylamide), vinyl alcohol and its ethers (e.g., vinyl methyl ether, vinyl ethyl ether and vinyl propyl ether), esters of vinyl alcohol with a compound having a carboxyl group (i.e., vinyl acetate, vinyl propionate and vinyl butyrate); acrylic amides (e.g, acrylamide, methacrylamide and diacetoneacrylamide) and their methylol compounds, acid chlorides (e.g., acrylic acid chloride and methacrylic acid chloride), and monomers having a nitrogen atom or an alicyclic ring having a nitrogen atom (e.g., vinyl pyridine, vinyl pyrrolidone, vinyl imidazole and ethyleneimine). In addition, polymers such as polyoxyethylene compounds (e.g., polyoxyethylene, polyoxypropylene, polyoxyethylenealkyl amines, polyoxypropylenealkyl amines, polyoxyethylenealkyl amides, polyoxypropylenealkyl amides, polyoxyethylene nonylphenyl ethers, polyoxyethylene laurylphenyl ethers, polyoxyethylene stearylphenyl esters, and polyoxyethylene nonylphenyl esters); and cellulose compounds such as methyl cellulose, hydroxyethylcellulose and hydroxypropylcellulose, can also be used as the polymeric protective colloid.

The dispersion method is not particularly limited, and conventional dispersion facilities, e.g., low speed shearing type, high speed shearing type, friction type, high pressure jet type and ultrasonic type dispersers can be used. Among them, the high speed shearing type dispersion methods are preferable for preparing a dispersion including grains with a grain size of 2 μm to 20 μm. The number of rotation of the high speed shearing type dispersers is not particularly limited, but is usually 1,000 rpm (revolutions per minute) to 30,000 rpm, and preferably 5,000 rpm to 20,000 rpm. While the dispersion time is not limited, it is usually 0.1 minute to 5 minutes for the batch system. The dispersion temperature is usually 0 degree Celsius to 150 degrees Celsius, and preferably 40 degrees Celsius to 98 degrees Celsius under a pressurized condition.

At the same time as the production of the emulsion, an amine (B) is added to the emulsion to be reacted with the polyester prepolymer (A) having isocyanate groups.

The reaction causes the crosslinking and/or extension of the molecular chains to occur. The elongation and/or crosslinking reaction time is determined depending on the reactivity of the isocyanate structure of the prepolymer (A) and amine (B) used, but is typically from 10 minutes to 40 hours, and preferably from 2 hours to 24 hours. The reaction temperature is typically from 0° C. to 150° C., and preferably from 40° C. to 98° C. In addition, a known catalyst such as dibutyltinlaurate and dioctyltinlaurate can be used. The amines (B) are used as the elongation agent and/or crosslinker.

After the above reaction, the organic solvent is removed from the emulsion (reaction product), and the resultant particles are washed and then dried. Thus mother toner particles are prepared.

To remove the organic solvent, the entire system is gradually heated in a laminar-flow agitating state. In this case, when the system is strongly agitated in a preselected temperature range, and then subjected to a solvent removal treatment, fusiform mother toner particles can be produced. Alternatively, when a dispersion stabilizer, e.g., calcium phosphate, which is soluble in acid or alkali, is used, calcium phosphate is preferably removed from the toner mother particles by being dissolved by hydrochloric acid or similar acid, followed by washing with water. Further, such a dispersion stabilizer can be removed by a decomposition method using an enzyme.

Then a charge control agent is penetrated into the mother toner particles, and inorganic fine particles such as silica, titanium oxide etc. are added externally thereto to obtain the toner of the present invention.

When preparing the toner by mixing the mother toner particles with an external additive and the lubricant, the external additive and the lubricant may be added individually or at the same time. The mixing operation of the external additive and the lubricant with the mother toner particles can be carried out using a conventional mixer, which preferably includes a jacket to control the inner temperature of the mixer. Suitable mixers are V-type mixers, rocking mixers, Ledige mixers, nauter mixers and Henschel mixers. Preferably, the rotational speed, mixing time and/or mixing temperature are optimized to prevent embedding of the external additive into the mother toner particles and forming a thin layer on the surface of the lubricant.

Thus, a toner having a small particle size and a sharp particle distribution can be obtained easily. Moreover, by controlling the stirring conditions when removing the organic solvent, the particle shape of the particles can be controlled so as to be any shape between perfectly spherical and rugby ball shape. Furthermore, the conditions of the surface can also be controlled so as to be any condition between smooth surface and rough surface such as the surface of pickled plum.

The thus prepared toner is mixed with a magnetic carrier to be used as a two-component developer. In this case, the toner is included in the two-component developer in an amount of from 1 part by weight to 10 parts by weight per 100 parts by weight of the carrier. As an alternative, the toner of the present invention can be used as a one-component magnetic or non-magnetic developer.

The image forming unit 30 according to an exemplary embodiment of the present invention forms and functions as a process cartridge that is removably installable in the image forming apparatus 100 and integrally includes the photoconductor 1 for forming an image on the surface thereof and at least one of the charging unit 2, the developing unit 3, and the cleaning unit 4. Maintenance of the image forming unit 30 can be performed by only replacing the process cartridge with a new one, which can enhance the convenience of the image forming apparatus 100.

Further, in the process cartridge according to an exemplary embodiment of the present invention, the color image carriers 1Y, 1C, and 1M that carry respective color toner images are aligned in contact with the intermediate transfer member (i.e., the intermediate transfer belt 6) and the developing unit 3B of the black image carrier 1B is disposed separately from the color image carriers 1Y, 1C, and 1M and upstream from the intermediate transfer belt 6 in a direction of movement of a recording medium, which can achieve the same effect as the image forming apparatus 100 according to the present invention.

The color image forming process of the image forming apparatus 100 according to the present invention enables recycling and reuse of toner collected from the black image carrier 1B without mixing of black toner with other color toners such as yellow, cyan, and magenta toners, and therefore can prevent degradation in color and image quality and contribute to resource conservation and cost reduction.

Further, since a direct transfer system is employed for transferring black images onto a transfer member, the number of parts used in the components of the image forming apparatus 100 can be reduced, and the exposure unit or optical writing unit 5 can write a latent image of the black toner with laser light beam in the same direction as those of the yellow, cyan, and magenta image. This can avoid complexity of writing control of the optical writing unit 5, and therefore can make the image forming apparatus 100 contribute to cost reduction in manufacturing, operation and so forth.

When forming images in the monochrome mode, the intermediate transfer belt 6 and other units used for the color image forming process can be suspended. At this time, the image forming apparatus 100 that is a full-color image forming apparatus can reduce the running cost substantially equal to that of a monochrome image forming apparatus. Known full-color image forming apparatuses can also suspend the operations of image forming units by separating, for example, an intermediate transfer belt and a transfer sheet conveyance belt, however, the intermediate transfer belt and the transfer sheet conveyance belt may keep rotating. As the above-described intermediate transfer belt provided in the full-color image forming apparatus keeps wearing and shortens its mechanical life, the running cost of the known full-color image forming apparatus may not be equal to that of the known monochrome image forming apparatus.

According to the above-described exemplary embodiment, the image forming apparatus 100 includes the intermediate transfer belt 6 that serves as a first belt member, the image forming unit 30 (30Y, 30C, and 30M) that serves as a first image forming unit, the photoconductor 1 (1Y, 1C, and 1M) that serves as at least one first color image carrier, the primary image transfer roller 14 that serves as a primary transfer member, the secondary image transfer mechanism 25 that serves as a secondary transfer mechanism, the image forming unit 30B that serves as a second image forming unit, the photoconductor 1B that serves as a separate second image carrier, the direct transfer roller 15, the recording medium conveyance belt 8 that serves as a secondary belt member, the controller 50, and the optical sensor (11 and 18) that serves as a first image detector. The intermediate transfer belt 6 is rotatably extended around multiple roller members. The first image forming unit 30 includes the photoconductor 1 disposed facing an outer surface of the intermediate transfer belt 6. The image forming unit 30 forms a first image on the photoconductor 1. The primary transfer roller 14 transfers the first image formed on the photoconductors 1 onto the intermediate transfer belt 6. The secondary transfer mechanism 25 transfers the first image formed on the intermediate transfer belt 6 onto a recording medium at a secondary transfer position. The image forming unit 30B forms a second image on the photoconductor 1B that is separate from the photoconductor 1. The photoconductor 1B is disposed either upstream or downstream from the secondary transfer position in a direction of conveyance of the recording medium. The direct transfer roller 15 transfers the second image formed on the photoconductor 1B directly onto the recording medium at a direct transfer position. The recording medium conveyance belt 8 is rotatably extended around multiple roller members to carry the recording medium to the direct transfer position and then to the secondary transfer position. The controller 50 transfers reference pattern images formed on the photoconductor 1 (1Y, 1C, or 1M) and the photoconductor 1B onto one of the intermediate transfer belt 6 and the recording medium conveyance belt 8. The optical sensor 11 is disposed facing one of the intermediate transfer belt 6 and the recording medium conveyance belt 8 to detect positional deviation of transferred images from the reference pattern images. The controller 50 conveys the reference pattern images to the optical sensor 11 or 18, causes the optical sensor 11 or 18 to detect the reference pattern images, and adjusts one or more image forming conditions of the image forming apparatus 100 to prevent positional deviation of the transferred images from the reference pattern images based on detection results obtained by the optical sensor 11 or 18. With the above-described configuration, positional deviation of the transferred images on the recording medium can be prevented.

Further, according to the above-described exemplary embodiment, the image forming apparatus 100 further includes the recording medium conveyance belt cleaning unit 9 that removes foreign material remaining on the recording medium conveyance belt 8. The recording medium conveyance belt cleaning unit 9 is disposed downstream from a transfer end position in a direction of rotation of the recording medium conveyance belt 8. The first end portion is one of the direct transfer position and the secondary transfer position, the one of which is disposed downstream from the other in a direction of conveyance of the recording medium. The optical sensor 11 is disposed facing the outer surface of the recording medium conveyance belt 8, downstream from the transfer end position in a direction of rotation of the recording medium conveyance belt 8, downstream from a separation position where the recording medium held on the recording medium conveyance belt 8 is separated from the recording medium conveyance belt 8, and upstream from the recording medium conveyance belt cleaning unit 9. In the area to dispose the optical sensor 11 from the separation position to the recording medium conveyance belt cleaning unit 9, a non-illustrated unit case that supports the recording medium conveyance belt 8 is provided between where the image forming units 30Y, 30C, 30M, and 30B are installed and where the recording medium with an image formed thereon is conveyed. This configuration can prevent scattered toner entering an area to contaminate the optical sensor 11. Further, the optical sensor 11 is disposed facing the roller that separates from the recording medium conveyance belt 8. By so doing, the optical sensor 11 can be free from noise due to vibration caused by the rotation of the recording medium conveyance belt 8, and can obtain more accurate detection results.

According to the above-described exemplary embodiment, the image forming apparatus 100 in Example Configuration 1 includes the photoconductors 1Y, 1C, and 1M that serve as multiple first color image carriers, the intermediate transfer belt cleaning unit 7 that serves as a second cleaning unit, the contact and separation mechanism 20 that serves as a contact and separation mechanism, and the optical sensor 18 that also serves as a second image detector. The photoconductors 1Y, 1C, and 1M are disposed facing the outer surface of the intermediate transfer belt 6. The intermediate transfer belt cleaning unit 7 removes foreign material from the intermediate transfer belt 6. The contact and separation mechanism 20 selectively moves the intermediate transfer belt 6 and the recording medium conveyance belt 8 into and out of contact with each other. The optical sensor 18 is disposed facing the outer surface of the intermediate transfer belt 6, downstream from the secondary transfer position and upstream from the intermediate transfer belt cleaning unit 7 in a direction of rotation of the intermediate transfer belt 6. The reference pattern images are formed on the photoconductors 1Y, 1C, and 1M and transferred onto the intermediate transfer belt 6. The image formed by the image carrier 1B is transferred onto the recording medium to form a monochrome image in a monochrome mode of operation of the image forming apparatus 100. The contact and separation mechanism 20 separates the intermediate transfer belt 6 and the recording medium conveyance belt 8 from each other in the monochrome mode. The reference pattern images are formed on the photoconductors 1Y, 1C, and 1M to adjust positions of the reference pattern images in a predetermined range on the intermediate transfer belt 6 and are transferred onto the intermediate transfer belt 6. The optical sensor 18 detects the positions of the reference pattern images. The controller 50 adjusts one or more image forming conditions for image transfer onto the photoconductors 1Y, 1C, and 1M based on a detection result obtained by the optical sensor 18. With this configuration, positional deviation and image density of the color images (yellow, cyan, and magenta images) can be adjusted during the monochrome mode.

Further, according to the above-described exemplary embodiment, after completion of operation in the monochrome mode and before a start of a subsequent image forming operation with the photoconductors 1Y, 1C, 1M, and 1B, the reference pattern images are formed on one of the photoconductors 1Y, 1C, and 1M and the photoconductor 1B are transferred onto the recording medium conveyance belt 8. The optical sensor 11 detects positions of the reference pattern images on the recording medium conveyance belt 8. The controller 50 adjusts the one or more image forming conditions for image transfer onto the photoconductors 1Y, 1C, 1M, and 1B based on the detection results obtained by the optical sensor 11. With this configuration, color registration of yellow, cyan, magenta, and black can be preformed with the reference pattern images formed on two photoconductors with a shorter time and a smaller amount of toner than that performed with four photoconductors, which are the photoconductors 1Y, 1C, 1M, and 1B.

Further, according to the above-described exemplary embodiment, while the reference pattern images transferred onto the intermediate transfer belt 6 are in the secondary transfer position during the monochrome mode, the secondary image transfer mechanism 25 is supplied with a bias charge to form an electric field attracting the reference pattern images electrostatically to the intermediate transfer belt 6. With this configuration, the color image formed on the intermediate transfer belt 6 can be prevented from moving to the recording medium with monochrome image toner particles remaining on the recording medium in the region of the secondary image transfer mechanism 25.

Further, according to the above-described exemplary embodiment, a transfer end portion is defined as one of the direct transfer position and the secondary image transfer position, the one of which being disposed downstream from the other in a direction of conveyance of the recording medium. The reference pattern images formed on the photoconductors 1Y, 1C, 1M, and 1B are transferred onto the recording medium conveyance belt 8. The optical sensor 11 is disposed facing the outer surface of the recording medium conveyance belt 8, downstream from the transfer end position, and upstream from a separation position where the recording medium held on the recording medium conveyance belt 8 is separated from the recording medium conveyance belt 8 in a direction of rotation of the recording medium conveyance belt 8. With this configuration, separate from the previously described detection of the reference pattern images, the amount of toner on the recording medium and the time when the recording medium passes a predetermined position can be detected.

Further, according to the above-described exemplary embodiment, the optical sensor 11 detects the recording medium when the recording medium passes a position opposite the optical sensor 11. The controller 50 displays an indication of a paper jam when the optical sensor 11 detects no passage of the recording medium at a predetermined time. With this configuration, the paper jam that has occurred upstream from the optical sensor 11 in the direction of movement of the recording medium conveyance belt 8 and informs the paper jam to user.

Further, according to the above-described exemplary embodiment, the image forming units 30 (30Y, 30C, or 30M) and the image forming unit 30B form a first toner image and a second toner image on the photoconductor 1 (1Y, 1C, or 1M) and the photoconductor 1B, respectively. The optical sensor 11 detects an amount of toner on the recording medium. The amount of toner detected by the optical sensor 11 is out of a given reference range, the controller 50 adjusts at least one of the one or more image forming conditions of either the photoconductor 1 (1Y, 1C, or 1M) or the photoconductor 1B and either the primary image transfer roller 14 or the secondary image transfer mechanism 25 (the controller 50 adjusts a transfer bias to be applied to the primary image transfer roller 14 and the secondary transfer roller 16 or the belt supporting roller 17 of the secondary image transfer mechanism 25). With this configuration, the optical sensor 11 detects the image density itself on the recording medium so as to obtain a desired image density.

Further, according to the above-described exemplary embodiment, the image forming apparatus 100 includes the intermediate transfer belt cleaning unit 7 that serves as a cleaning unit to remove foreign material from the intermediate transfer belt 6. A transfer end portion is defined as one of the direct transfer position and the secondary transfer position, the one of which being disposed downstream from the other in a direction of conveyance of the recording medium. The reference pattern images formed on the photoconductors 1Y, 1C, 1M, and 1B are transferred onto the recording medium conveyance belt 8. The optical sensor 18 that serves as an optical sensor is disposed facing the outer surface of the intermediate transfer belt 6, downstream from the transfer end position and upstream from the intermediate transfer belt cleaning unit 7 in a direction of rotation of the intermediate transfer belt 6. With this configuration, the optical sensor 18 can be disposed away from the fixing unit 10 to reduce the thermal load of the optical sensor 18. Further, the optical sensor 18 is located away from the area where toner is scattered in the secondary image transfer and/or the recording medium conveyance, and therefore the amount of toner contamination accumulated around the optical sensor 18 can be reduced.

Further, according to the above-described exemplary embodiment, the intermediate transfer belt 6 includes an elastic belt. With this configuration, the intermediate transfer belt 6 elastically deforms the surface of the intermediate transfer belt 6 followed by an uneven surface of the recording medium having convex and concave portions, which can prevent poor transferability of the color image from the intermediate transfer belt 6 onto the recording medium. However, the surface of such an elastic belt has low glossiness, and therefore it is likely that the optical sensor cannot detect the density of the pattern images formed on the intermediate transfer belt 6 correctly. Therefore, when performing the process control between copies or using the elastic belt as the intermediate transfer belt 6, it is preferable that the reference pattern images are formed on the recording medium conveyance belt 8 so that the optical sensor 11 detects the pattern images on the recording medium conveyance belt 8. By so doing, a degradation in detection accuracy of the optical sensor to detect image density of the reference pattern images can be suppressed more than when performing the detection of image density of the reference pattern images on the elastic belt by the optical sensor.

When an optical sensor (11 or 18) is disposed facing the outer surface of the intermediate transfer belt 6 and downstream from the secondary transfer nip portion in the direction of rotation of the intermediate transfer belt 6, it may be difficult to detect a density of pattern images for density control (or process control between copies) in a time period between one recording medium and a subsequent recording medium. The reason of this problem is that, even if pattern images are formed on the intermediate transfer belt 6 and the recording medium conveyance belt 8 in a period from when an image formed on the intermediate transfer belt 6 is transferred onto the recording medium to when the image is transferred onto the subsequent recording medium, a bias switching operation cannot be made correctly. The bias switching operation switches biases to be applied to the secondary image transfer unit 25 between a bias for transferring from the intermediate transfer belt 6 onto a recording medium conveyed by the recording medium conveyance belt 8 an image at the secondary image transfer nip portion and a bias for transferring from the pattern image formed on the recording medium conveyance belt 8 onto the intermediate transfer belt 6 at the secondary image transfer nip portion. Therefore, the pattern images formed on the intermediate transfer belt 6 can be transferred on the recording medium conveyance belt 8 at the secondary image transfer nip portion.

Further, as described above, an elastic belt may be employed to handle various recording media appropriately, or in other words, to elastically change the surface of the intermediate transfer belt 6 in accordance with unevenness of the surface of the recording medium, so as to reduce poor transferability of color images from the intermediate transfer belt 6 onto the recording medium. In this case, however, the surface of such an elastic belt has low glossiness, and therefore it is likely that the optical sensor cannot detect the density of the pattern images formed on the intermediate transfer belt 6 correctly.

Therefore, when performing the process control between copies or using the elastic belt as the intermediate transfer belt 6, it is preferable that the optical sensor 11 detects the pattern images on the recording medium conveyance belt 8.

The above-described exemplary embodiments are illustrative, and numerous additional modifications and variations are possible in light of the above teachings. For example, elements and/or features of different illustrative and exemplary embodiments herein may be combined with each other and/or substituted for each other within the scope of this disclosure. It is therefore to be understood that, the disclosure of this patent specification may be practiced otherwise than as specifically described herein.

Obviously, numerous modifications and variations of the present invention are possible in light of the above teachings. It is therefore to be understood that, the invention may be practiced otherwise than as specifically described herein.

What is claimed is:

1. An image forming apparatus, comprising:

a first belt member rotatably extended around multiple roller members;

a first image forming unit including at least one first color image carrier disposed facing an outer surface of the first belt member, the first image forming unit to form a first image on the at least one first color image carrier;

a primary transfer member to transfer the first image formed on the at least one first color image carrier onto the first belt member;

a secondary transfer mechanism to transfer the first image formed on the first belt member onto a recording medium at a secondary transfer position;

a second image forming unit to form a second image on a separate second image carrier separate from the at least one first color image carrier, the separate second image carrier disposed either upstream or downstream from the secondary transfer position in a direction of conveyance of the recording medium;

a direct transfer member to transfer the second image formed on the separate second image carrier directly onto the recording medium at a direct transfer position;

a second belt member rotatably extended around multiple roller members to carry the recording medium to the direct transfer position and then to the secondary transfer position;

a controller to transfer reference pattern images formed on the at least one first color image carrier and the separate second image carrier onto one of the first belt member and the second belt member; and a first image detector disposed facing one of the first belt member and the second belt member to detect positional deviation of transferred images from the reference pattern images, the controller conveying the reference pattern images to the first image detector, causing the first image detector to detect the reference pattern images, and adjusting one or more image forming conditions of the image forming apparatus to prevent positional deviation of the transferred images from the reference pattern images based on detection results obtained by the first image detector, the image forming apparatus further comprising a first cleaning unit that removes foreign material remaining on the second belt member, the first cleaning unit disposed downstream from a transfer end position in a direction of rotation of the second belt member, the transfer end position being one of the direct transfer position and the secondary transfer position, the one of which being disposed downstream from the other in a direction of conveyance of the recording medium, wherein the first image detector is disposed facing an outer surface of the second belt member, downstream from the transfer end position in a direction of rotation of the second belt member, downstream from a separation position where the recording medium held on the second belt member is separated from the second belt member, and upstream from the first cleaning unit.

2. The image forming apparatus according to claim 1, wherein the first belt member comprises an elastic belt.

3. The image forming apparatus according to claim 1, further comprising:

multiple first color image carriers disposed facing the outer surface of the first belt member;

a second cleaning unit to remove foreign material from the first belt member;

a contact and separation mechanism to selectively move the first belt member and the second belt member into and out of contact with each other; and a second image detector disposed facing the outer surface of the first belt member, downstream from the secondary transfer position and upstream from the second cleaning unit in a direction of rotation of the first belt member, the reference pattern images being formed on the multiple first color image carriers and transferred onto the first belt member, the second image formed by the separate second image carrier being transferred onto the recording medium to form a monochrome image in a monochrome mode of operation of the image forming apparatus, the contact and separation mechanism separating the first belt member and the second belt member from each other in the monochrome mode, the reference pattern images of the first image being formed on the multiple first color image carriers to adjust positions of the reference pattern images in a predetermined range on the first belt member and be transferred onto the first belt member, the second image detector detecting the positions of the reference pattern images, the controller adjusting one or more image forming conditions for image transfer onto the multiple first color image carriers based on a detection result obtained by the second image detector.

4. The image forming apparatus according to claim 3, wherein, while the reference pattern images transferred on the first belt member are in the secondary transfer position during the monochrome mode, the secondary transfer mechanism is supplied with a bias charge to form an electric field attracting the reference pattern images electrostatically to the first belt member.

5. The image forming apparatus according to claim 3, wherein, after completion of operation in the monochrome mode and before a start of a subsequent image forming operation with the separate second image carrier and the multiple first color image carriers, the reference pattern images are formed on both the multiple first color image carriers and the separate second image carrier and are transferred onto the second belt member, the first image detector detects positions of the reference pattern images on the second belt member, and the controller adjusts the one or more image forming conditions for image transfer onto the multiple first color image carriers and the separate second image carrier based on the detection results obtained by the first image detector.

6. The image forming apparatus according to claim 3, wherein, while the reference pattern images transferred onto the first belt member are in the secondary transfer position during the monochrome mode, the secondary transfer mechanism is supplied with a bias charge to form an electric field attracting the reference pattern images electrostatically to the first belt member.

7. An image forming apparatus, comprising:

a first belt member rotatably extended around multiple roller members;

a first image forming unit including at least one first color image carrier disposed facing an outer surface of the first belt member, the first image forming unit to form a first image on the at least one first color image carrier;

a primary transfer member to transfer the first image formed on the at least one first color image carrier onto the first belt member;

a secondary transfer mechanism to transfer the first image formed on the first belt member onto a recording medium at a secondary transfer position;

a second image forming unit to form a second image on a separate second image carrier separate from the at least one first color image carrier, the separate second image carrier disposed either upstream or downstream from the secondary transfer position in a direction of conveyance of the recording medium;

a direct transfer member to transfer the second image formed on the separate second image carrier directly onto the recording medium at a direct transfer position;

a second belt member rotatably extended around multiple roller members to carry the recording medium to the direct transfer position and then to the secondary transfer position;

a controller to transfer reference pattern images formed on the at least one first color image carrier and the separate second image carrier onto one of the first belt member and the second belt member; and a first image detector disposed facing one of the first belt member and the second belt member to detect positional deviation of transferred images from the reference pattern images, the controller conveying the reference pattern images to the first image detector, causing the first image detector to detect the reference pattern images, and adjusting one or more image forming conditions of the image forming apparatus to prevent positional deviation of the transferred images from the reference pattern images based on detection results obtained by the first image detector, wherein a transfer end position is one of the direct transfer position and the secondary transfer position, the one of which being disposed downstream from the other in a direction of conveyance of the recording medium, the reference pattern images formed on the at least one first color image carrier and the separate second image carrier being transferred onto the second belt member, the first image detector being disposed facing an outer surface of the second belt member, downstream from the transfer end position, and upstream from a separation position where the recording medium held on the second belt member is separated from the second belt member in a direction of rotation of the second belt member.

8. The image forming apparatus according to claim 7, wherein the first image detector detects the recording medium when the recording medium passes a position opposite the first image detector, the controller displaying an indication of a paper jam when the first image detector detects no passage of the recording medium at a predetermined time.

9. The image forming apparatus according to claim 8, wherein the first image forming unit and the second image forming unit form a first toner image and a second toner image on the at least one first color image carrier and the separate second image carrier, respectively, the first image detector detects an amount of toner on the recording medium, and when the amount of toner detected by the first image detector is out of a given reference range, the controller adjusts at least one of the one or more image forming conditions of either the at least one first color image carrier or the separate second image carrier and either the primary transfer member or the secondary transfer mechanism.

10. The image forming apparatus according to claim 7, wherein the first image forming unit and the second image forming unit form a first toner image and a second toner image on the at least one first color image carrier and the separate second image carrier, respectively, the first image detector detects an amount of toner on the recording medium, and when the amount of toner detected by the first image detector is out of a given reference range, the controller adjusts at least one of the image forming conditions of either the at least one first color image carrier or the separate second image carrier and either the primary transfer member or the secondary transfer mechanism.

11. The image forming apparatus according to claim 7, wherein the first belt member comprises an elastic belt.

12. An image forming apparatus, comprising:

a first belt member rotatably extended around multiple roller members;

a first image forming unit including at least one first color image carrier disposed facing an outer surface of the first belt member, the first image forming unit to form a first image on the at least one first color image carrier;

a primary transfer member to transfer the first image formed on the at least one first color image carrier onto the first belt member;

a secondary transfer mechanism to transfer the first image formed on the first belt member onto a recording medium at a secondary transfer position;

a second image forming unit to form a second image on a separate second image carrier separate from the at least one first color image carrier, the separate second image carrier disposed either upstream or downstream from the secondary transfer position in a direction of conveyance of the recording medium;

a direct transfer member to transfer the second image formed on the separate second image carrier directly onto the recording medium at a direct transfer position;

a second belt member rotatably extended around multiple roller members to carry the recording medium to the direct transfer position and then to the secondary transfer position;

a controller to transfer reference pattern images formed on the at least one first color image carrier and the separate second image carrier onto one of the first belt member and the second belt member; and a first image detector disposed facing one of the first belt member and the second belt member to detect positional deviation of transferred images from the reference pattern images, the controller conveying the reference pattern images to the first image detector, causing the first image detector to detect the reference pattern images, and adjusting one or more image forming conditions of the image forming apparatus to prevent positional deviation of the transferred images from the reference pattern images based on detection results obtained by the first image detector, the image forming apparatus further comprising a cleaning unit to remove foreign material from the first belt member after image transfer, wherein a transfer end position is one of the direct transfer position and the secondary transfer position, the one of which being disposed downstream from the other in a direction of conveyance of the recording medium, the reference pattern images formed on the at least one first color image carrier and the separate second image carrier being transferred onto the second belt member, and the first image detector being disposed facing the outer surface of the first belt member, downstream from the transfer end position and upstream from the cleaning unit in a direction of rotation of the first belt member.

* * * * *